US009816429B2

(12) United States Patent
Murai et al.

(10) Patent No.: US 9,816,429 B2
(45) Date of Patent: Nov. 14, 2017

(54) COOLING DEVICE FOR INTERNAL COMBUSTION ENGINE AND CONTROL METHOD FOR COOLING DEVICE

(71) Applicant: Hitachi Automotive Systems, Ltd., Hitachinaka-shi, Ibaraki (JP)

(72) Inventors: Atsushi Murai, Isesaki (JP); Tomoyuki Murakami, Isesaki (JP); Shigeyuki Sakaguchi, Isesaki (JP); Yuichi Toyama, Isesaki (JP); Masahiko Watanabe, Isesaki (JP); Hideaki Nakamura, Isesaki (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 0 days.

(21) Appl. No.: 15/126,850

(22) PCT Filed: Sep. 29, 2014

(86) PCT No.: PCT/JP2014/075827
§ 371 (c)(1),
(2) Date: Sep. 16, 2016

(87) PCT Pub. No.: WO2015/141042
PCT Pub. Date: Sep. 24, 2015

(65) Prior Publication Data

US 2017/0096930 A1 Apr. 6, 2017

(30) Foreign Application Priority Data

Mar. 19, 2014 (JP) ..... 2014-057247

(51) Int. Cl.
*F01P 7/14* (2006.01)
*F01P 7/16* (2006.01)
(Continued)

(52) U.S. Cl.
CPC *F01P 7/16* (2013.01); *F01P 3/18* (2013.01); *F01P 5/12* (2013.01); *F01P 7/14* (2013.01);
(Continued)

(58) Field of Classification Search
CPC F01P 11/04; F01P 2003/024; F01P 2007/146; F01P 2007/143; F01P 7/14; F01P 5/10; F01P 3/02; F01P 7/16
See application file for complete search history.

(56) References Cited

U.S. PATENT DOCUMENTS

2007/0137592 A1* 6/2007 Hanai ..... F01P 11/20 123/41.14
2013/0047940 A1 2/2013 Quix et al.
(Continued)

FOREIGN PATENT DOCUMENTS

JP 7-101006 B2 11/1995
JP 2003-293767 A 10/2003
(Continued)

OTHER PUBLICATIONS

International Preliminary Report on Patentability (PCT/IB/326, PCT/IB/338 & PCT/IB/373) issued in PCT Application No. PCT/JP2014/075827 dated Sep. 29, 2016, including English translation of document C2 (Japanese-language Written Opinion (PCT/ISA/237)) previously filed on Sep. 19, 2016 (seven (7) pages).
(Continued)

*Primary Examiner* — Jacob Amick
(74) *Attorney, Agent, or Firm* — Crowell & Morning LLP

(57) ABSTRACT

The present invention relates to a cooling device and a control method therefor. This cooling device includes: a first cooling liquid line routed by way of a cylinder head and a radiator; a second cooling liquid line routed by way of a cylinder block while bypassing the radiator; a third cooling liquid line routed by way of the cylinder head and a heater
(Continued)

core while bypassing the radiator; a flow rate control valve for distributing cooling water to the cooling liquid lines; and mechanical and electric water pumps. A control unit controls the flow rate control valve according to the temperatures of the cylinder head and block, during engine operation, and causes the electric water pump to operate while controlling the flow rate control valve according to the temperature of the cylinder head, and whether or not heat exchange in the heater core is requested, during temporary engine stop.

16 Claims, 9 Drawing Sheets

(51) Int. Cl.
*F01P 3/18* (2006.01)
*F01P 5/12* (2006.01)

(52) U.S. Cl.
CPC ..... *F01P 2005/125* (2013.01); *F01P 2025/31* (2013.01); *F01P 2037/00* (2013.01)

(56) References Cited

U.S. PATENT DOCUMENTS

| | | | | |
|---|---|---|---|---|
| 2013/0221116 | A1* | 8/2013 | Tsuchiya | F01P 7/14 236/34.5 |
| 2014/0283765 | A1* | 9/2014 | Naito | F01P 3/12 123/41.09 |

FOREIGN PATENT DOCUMENTS

| | | | |
|---|---|---|---|
| JP | 2008-248715 | A | 10/2008 |
| JP | 2010-43555 | A | 2/2010 |
| JP | 4513522 | B2 | 7/2010 |
| JP | 4985417 | B2 | 7/2012 |
| JP | 2012-184693 | A | 9/2012 |
| JP | 2012-197706 | A | 10/2012 |
| JP | 2014-20229 | A | 2/2014 |
| JP | 2014-145326 | A | 8/2014 |
| JP | 2014-163223 | A | 9/2014 |

OTHER PUBLICATIONS

German-language Office Action issued in counterpart German Application No. 112014006486.6 dated Dec. 22, 2016 with English translation (Seven (7) pages).

Japanese-language Office Action issued in counterpart Japanese Application No. 2014-057247 dated Jul. 18, 2017 with partial English translation (Eight (8) pages).

International Search Report (PCT/ISA/210) issued in PCT Application No. PCT/JP2014/075827 dated Nov. 25, 2014.

Written Opinion (PCT/ISA/237) issued in PCT Application No. PCT/JP2014/075827 dated Nov. 25, 2014, with English translation (six (6) pages).

* cited by examiner

COOLING DEVICE FOR INTERNAL COMBUSTION ENGINE AND CONTROL METHOD FOR COOLING DEVICE

TECHNICAL FIELD

The present invention relates to a cooling device which cools an internal combustion engine by circulating cooling liquid through a cylinder head and a cylinder block, and a control method for the cooling device.

BACKGROUND ART

Patent Document 1 discloses that, in a system including a cooling water circuit for air conditioning provided with an electric water pump, when an engine is stopped by idle reduction control, the electric water pump is activated to cause the cooling water to flow through the cooling water circuit for air conditioning so as to maintain air conditioning performance.

REFERENCE DOCUMENT LIST

Patent Document

Patent Document 1: JP 2008-248715 A

SUMMARY OF THE INVENTION

Problems to be Solved by the Invention

While an internal combustion engine is in a warm-up operation, quickly increasing the temperature of the cylinder head can improve combustibility, and thus fuel economy, exhaust gas properties and the like of the internal combustion engine.

After the completion of the warm-up of the internal combustion engine, reducing the temperature rise in the cylinder head can prevent or reduce the occurrence of knocking, while increasing the temperature of the cylinder block can reduce friction, and thus improve fuel economy.

Under these circumstances, there has been a demand for providing a cooling device capable of individually controlling the temperatures of the cylinder head and the cylinder block.

Moreover, when the temperature of the cylinder head rises during temporary stop of the internal combustion engine by the idle reduction control, abnormal combustion such as pre-ignition and knocking might occur upon restart of the internal combustion engine, which reduces its startup performance. To avoid this, it is desired to cool the cylinder head during the temporary stop of the internal combustion engine, but this might cause a temperature drop of the cylinder block, which leads to a problematic increase of friction therein.

An object of the present invention is to provide a cooling device for an internal combustion engine and a control method for the cooling device which is capable of individually controlling the temperatures of the cylinder head and the cylinder block, and thereby improving fuel economy of the internal combustion engine, and its startup performance at the restart from temporary stop.

Means for Solving the Problems

To achieve the above, a cooling device for an internal combustion engine according to the present invention includes multiple cooling liquid lines, an electric flow rate control valve, a bypass line, a mechanical water pump, and an electric water pump. The multiple cooling liquid lines include a first cooling liquid line routed by way of a radiator and a cylinder head of the internal combustion engine while bypassing a cylinder block thereof, and a second cooling liquid line routed by way of the cylinder block while bypassing the radiator. The electric flow rate control valve has multiple inlet ports connected to outlets respectively of the multiple cooling liquid lines, and controls supply rates of cooling liquid respectively to the multiple cooling liquid lines. The bypass line branches off from the first cooling liquid line at a point between the cylinder head and the radiator, and connects with an outlet port of the flow rate control valve while bypassing the radiator. The mechanical water pump is driven by the internal combustion engine to circulate the cooling liquid. The electric water pump is driven by a motor to circulate the cooling liquid.

In a control method for a cooling device for an internal combustion engine according to the present invention, the cooling device includes multiple cooling liquid lines, an electric flow rate control valve, a bypass line, a mechanical water pump, and an electric water pump. The multiple cooling liquid lines include a first cooling liquid line routed by way of a radiator and a cylinder head of the internal combustion engine while bypassing a cylinder block thereof, and a second cooling liquid line routed by way of the cylinder block while bypassing the radiator. The electric flow rate control valve has multiple inlet ports connected to outlets respectively of the multiple cooling liquid lines, and controls supply rates of cooling liquid respectively to the multiple cooling liquid lines. The bypass line branches off from the first cooling liquid line at a point between the cylinder head and the radiator, and connects with an outlet port of the flow rate control valve while bypassing the radiator. The mechanical water pump is driven by the internal combustion engine to circulate the cooling liquid. The electric water pump is driven by a motor to circulate the cooling liquid. The control method includes the steps of: detecting temporary stop of the internal combustion engine; causing the electric water pump to operate in response to the temporary stop of the internal combustion engine; and switching a position of the flow rate control valve in response to the temporary stop of the internal combustion engine.

Effects of the Invention

According to the invention described above, temperature controllability of the cylinder head and temperature controllability of the cylinder block can be both improved, and thus the fuel economy and startup performance of the internal combustion engine can be improved.

MODE FOR CARRYING OUT THE INVENTION

Hereinafter, an embodiment of the present invention will be described.

Figure 1:
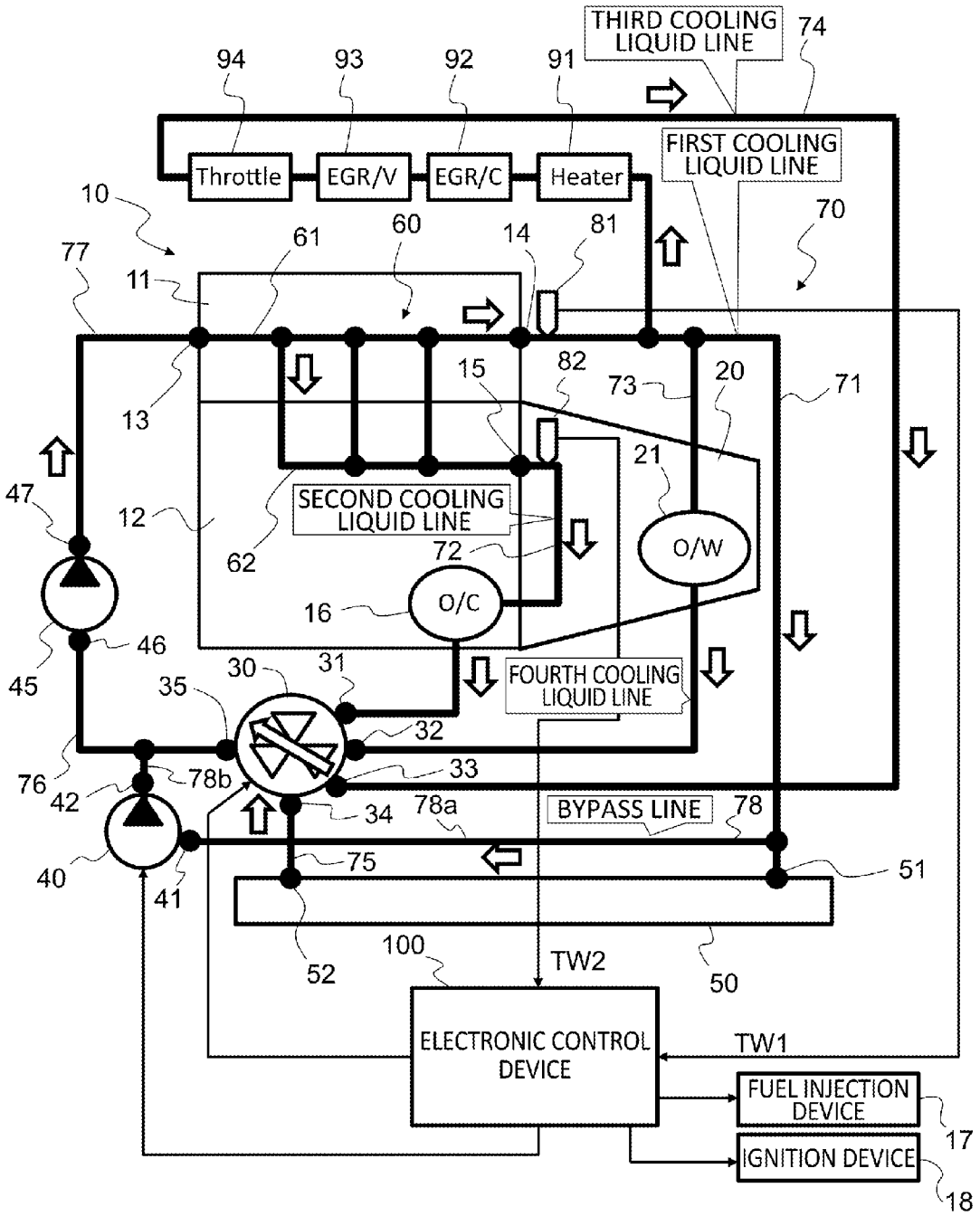
FIG. 1 is a schematic view of a cooling device for an internal combustion engine according to an embodiment of the present invention.

FIG. 1 illustrates the configuration of an example of a cooling device for an internal combustion engine according to the present invention.

An internal combustion engine 10 has a cylinder head 11 and a cylinder block 12. A transmission 20 such as a CVT, which is an example of a power transmission device, is coupled to the output shaft of internal combustion engine 10. The output of transmission 20 is transmitted to the unillustrated drive wheels. In other words, internal combustion engine 10 is used as a power source for driving a vehicle.

Internal combustion engine 10 is cooled by a water-cooled cooling device which circulates cooling water. The cooling device includes an electric flow rate control valve (motorized control valve) 30 actuated by an electric actuator, an electric water pump 40 driven by a motor to circulate the cooling water, a mechanical water pump 45 driven by internal combustion engine 10 to circulate the cooling water, a radiator 50, a cooling water passage 60 provided in internal combustion engine 10, and multiple pipes 70 connecting these components. Cooling water passage 60 and multiple pipes 70 constitute a cooling liquid circulation route.

The maximum discharge capacity of electric water pump 40 is set smaller than the maximum discharge capacity of mechanical water pump 45.

This is because, during the operation stop of internal combustion engine 10, less amount of the cooling water is required to circulate therethrough than during the operation of internal combustion engine 10, and the cooling water is circulated by mechanical water pump 45 during the operation of internal combustion engine 10, and circulated by electric water pump 40 during the operation stop of internal combustion engine 10. In other words, the maximum discharge capacity of electric water pump 40 is set based on the maximum circulation rate required during the operation stop of internal combustion engine 10.

Cylinder head 11 has a cooling water inlet 13 at one end in the cylinder arrangement direction, and a cooling water outlet 14 at the other end in the cylinder arrangement direction. In internal combustion engine 10, there is provided a cooling water passage 61 extending in cylinder head 11 so as to connect cooling water inlet 13 to cooling water outlet 14.

Cylinder block 12 has a cooling water outlet 15. In internal combustion engine 10, there is provided a cooling water passage 62 branching off from cooling water passage 61 and entering cylinder block 12 so as to extend in cylinder block 12 and to be connected to cooling water outlet 15. Cooling water outlet 15 is provided to cylinder block 12 at an end, on the same side where cooling water outlet 14 is provided, in the cylinder arrangement direction.

In the cooling device exemplified in FIG. 1, the cooling water is supplied through cylinder head 11 to cylinder block 12. The cooling water having passed through cylinder head 11 without flowing through cylinder block 12 is discharged from cooling water outlet 14. The cooling water having passed through cylinder head 11 and then through cylinder block 12 is discharged from cooling water outlet 15.

To cooling water outlet 14 of cylinder head 11, one end of a first cooling water pipe 71 is connected, while the other end thereof is connected to a cooling water inlet 51 of radiator 50.

To cooling water outlet 15 of cylinder block 12, one end of a second cooling water pipe 72 is connected, while the other end thereof is connected to a first inlet port 31 among four inlet ports 31 to 34 of flow rate control valve 30.

In the middle of second cooling water pipe 72, there is provided an oil cooler 16 which cools lubricant oil for internal combustion engine 10. Oil cooler 16 exchanges heat between the cooling water flowing through second cooling water pipe 72 and the lubricant oil for internal combustion engine 10.

A third cooling water pipe 73 is connected at one end to first cooling water pipe 71 and at the other end to second inlet port 32 of flow rate control valve 30. In the middle of third cooling water pipe 73, there is provided an oil warmer 21 which heats hydraulic oil of transmission 20.

Oil warmer 21 exchanges heat between the cooling water flowing through third cooling water pipe 73 and the hydraulic oil of transmission 20. In other words, third cooling water pipe 73 allows the cooling water having passed through cylinder head 11 to be partially diverted and introduced into water-cooled oil warmer 21 so as to heat the hydraulic oil in oil warmer 21.

A fourth cooling water pipe 74 is connected at one end to first cooling water pipe 71, and at the other end to third inlet port 33 of flow rate control valve 30.

Various heat exchanging devices are disposed on fourth cooling water pipe 74.

The heat exchanging devices described above are, in the order from upstream to downstream, a heater core 91, a water-cooled EGR cooler 92, an exhaust gas recirculation control valve 93 and a throttle valve 94. Heater core 91 heats air for air-conditioning in a vehicle air conditioner. EGR cooler 92 and exhaust gas recirculation control valve 93 for regulating an exhaust gas recirculation rate constitute an exhaust gas recirculation device of internal combustion engine 10. Throttle valve 94 regulates the amount of air intake in internal combustion engine 10.

Heater core 91 heats air for air-conditioning by exchanging heat between the air for air-conditioning and the cooling water in fourth cooling water pipe 74.

EGR cooler 92 exchanges heat between the cooling water in fourth cooling water pipe 74 and the exhaust gas recirculated into an intake system of internal combustion engine 10 by the exhaust gas recirculation device so as to lower the temperature of the exhaust gas recirculated into the intake system.

Exhaust gas recirculation control valve 93 and throttle valve 94 are heated by exchanging heat with the cooling water in fourth cooling water pipe 74. This configuration prevents the freeze of moisture in the exhaust gas around exhaust gas recirculation control valve 93 as well as moisture in the intake air around throttle valve 94.

As described above, fourth cooling water pipe 74 allows the cooling water having passed through cylinder head 11 to be partially diverted and introduced into heater core 91, EGR cooler 92, exhaust gas recirculation control valve 93 and throttle valve 94 so as to exchange heat therewith.

A fifth cooling water pipe 75 is connected at one end to a cooling water outlet 52 of radiator 50, and at the other end to fourth inlet port 34 of flow rate control valve 30.

Flow rate control valve 30 has an outlet port 35. A sixth cooling water pipe 76 is connected at one end to outlet port 35, and at the other end to an intake port 46 of mechanical water pump 45.

A seventh cooling water pipe 77 is connected at one end to a discharge port 47 of mechanical water pump 45, and at the other end to cooling water inlet 13 of cylinder head 11.

An eighth cooling water pipe 78 is connected at one end to first cooling water pipe 71, and at the other end to sixth cooling water pipe 76. Specifically, in first cooling water pipe 71, the point where eighth cooling water pipe 78 is connected is located downstream to the point connected to third cooling water pipe 73 and downstream to the point connected to fourth cooling water pipe 74.

As described above, flow rate control valve 30 includes four inlet ports 31 to 34 and outlet port 35. To inlet ports 31 to 34, cooling water pipes 72, 73, 74 and 75 are respectively connected, while sixth cooling water pipe 76 is connected to outlet port 35.

Flow rate control valve 30 is, for example, a rotational flow channel switching valve that includes a stator having multiple ports 31 to 35 formed therein, and a rotor having flow channels therein and being fitted in the stator. Flow rate control valve 30 connects the flow channels of the rotor to inlet ports 31 to 35 of the rotor in accordance with the angular position of the rotor changed as the rotor is rotationally driven by the electric actuator such as an electric motor.

In rotational flow rate control valve 30, the opening area ratio of four inlet ports 31 to 34 changes in accordance with the rotor angle. The flow channels and the like in the rotor are configured appropriately so as to make it possible to desirably control this opening area ratio by changing the rotor angle.

In the above configuration, cooling water passage 61 and first cooling water pipe 71 constitute a radiator cooling liquid line (first cooling liquid line), which is routed by way of cylinder head 11 and radiator 50 while bypassing cylinder block 12.

Cooling water passage 62 and second cooling water pipe 72 constitute a block cooling liquid line (second cooling liquid line), which is routed by way of cylinder block 12 while bypassing radiator 50.

Cooling water passage 61 and fourth cooling water pipe 74 constitute a heater-core cooling liquid line (third cooling liquid line), which is routed by way of cylinder head 11 and heater core 91 while bypassing radiator 50.

Cooling water passage 61 and third cooling water pipe 73 constitute a power-transmission-system cooling liquid line (fourth cooling liquid line), which is routed by way of cylinder head 11 and oil warmer 21 of transmission 20 while bypassing radiator 50.

In addition, eighth cooling water pipe 78 serves as a bypass line that branches off from the radiator cooling liquid line at a point between cylinder head 11 and radiator 50 and that connects with an outlet of flow rate control valve 30 while bypassing radiator 50.

In other words, outlets of the radiator cooling liquid line, the block cooling liquid line, the heater-core cooling liquid line and the power-transmission-system cooling liquid line are connected to the inlet of flow rate control valve 30, while the outlet of flow rate control valve 30 is connected to an intake side of mechanical water pump 45.

Flow rate control valve 30 is a switching valve for controlling the supply rates of the cooling water to the radiator cooling liquid line, the block cooling liquid line, the heater-core cooling liquid line and the power-transmission-system cooling liquid line by regulating the opening areas of the outlets of these cooling liquid lines.

The cooling device includes a temperature sensing unit for measuring the temperature of the cooling water. The temperature sensing unit includes a first temperature sensor 81 and a second temperature sensor 82.

First temperature sensor 81 measures a temperature TW1 of the cooling water in first cooling water pipe 71 near cooling water outlet 14, that is, the cooling water temperature TW1 near the outlet of cylinder head 11.

Second temperature sensor 82 measures a temperature TW2 of the cooling water in second cooling water pipe 72 near cooling water outlet 15, that is, the cooling water temperature TW2 near the outlet of cylinder block 12.

A measurement signal TW1 outputted by first temperature sensor 81 and a measurement signal TW2 outputted by second temperature sensor 82 are inputted to an electronic control device (controller or control unit) 100 including a microcomputer.

Electric water pump 40 is disposed in the middle of eighth cooling water pipe 78, which constitutes the bypass line. In other words, eighth cooling water pipe 78 includes an eighth cooling water pipe **78*a* connected at one end to first cooling water pipe 71 and at the other end to an intake port 41 of electric water pump 40, and an eighth cooling water pipe 78*b* connected at one end to a discharge port 42 of electric water pump 40 and at the other end to sixth cooling water pipe 76**.

Electronic control device 100 has functions of controlling the discharge rate of electric water pump 40 and the rotor angle of flow rate control valve 30, and controlling the operations of a fuel injection device 17, which injects fuel to internal combustion engine 10, and the operation of an ignition device 18.

Figure 2:
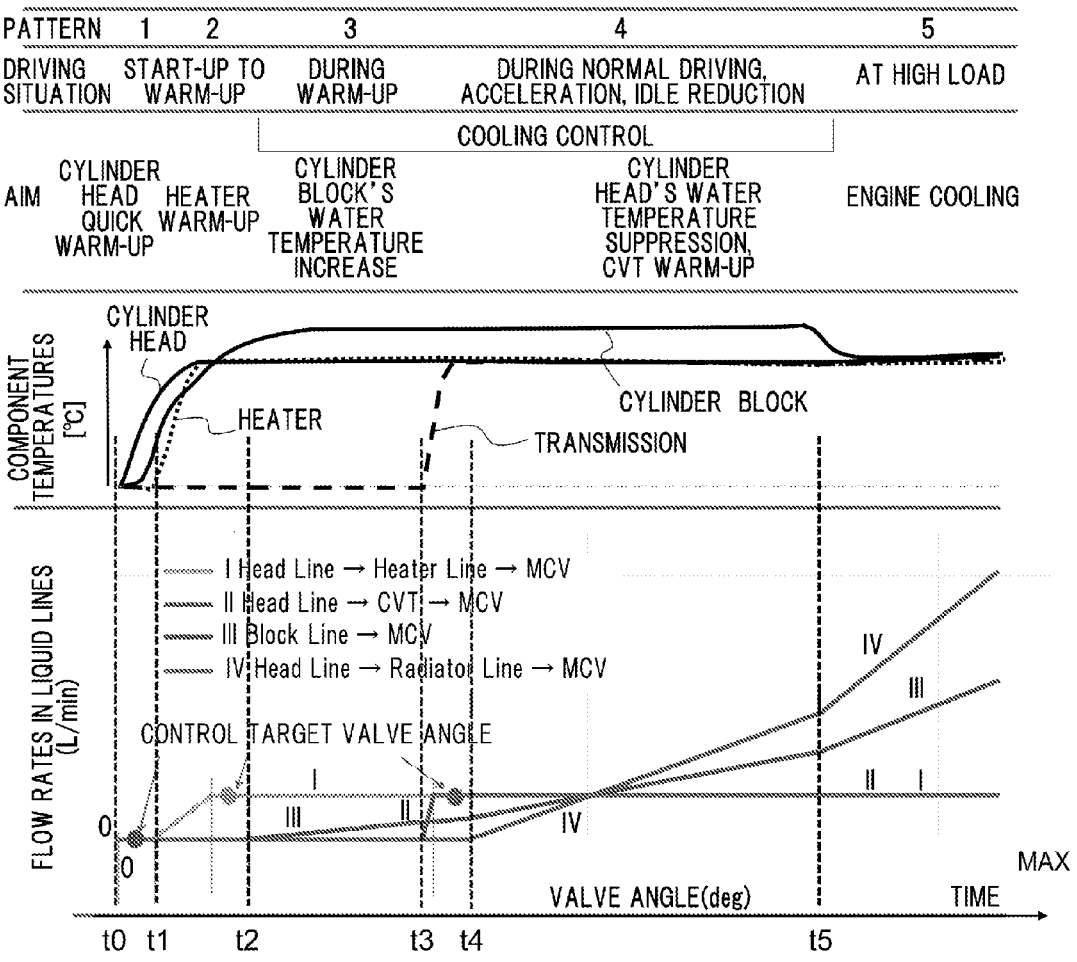
FIG. 2 is a time chart exemplifying switching characteristics of a flow rate control valve, and control of the flow rate control valve during the operation of the internal combustion engine, according to the embodiment of the present invention.

FIG. 2 is a schematic time chart exemplifying control that electronic control device 100 performs on flow rate control valve 30 during the operation of internal combustion engine 10.

During the operation of internal combustion engine 10, mechanical water pump 45 rotated by internal combustion engine 10 circulates the cooling water while electronic control device 100 stops the drive of electric water pump 40.

First, a description will be given of how the flow channels are switched therebetween in accordance with the rotor angle of flow rate control valve 30.

Flow rate control valve 30 closes all inlet ports 31 to 34 when the rotor angle is within a predetermined angle range from a reference angular position at which the rotor is regulated by a stopper. The position at which flow rate control valve 30 closes all inlet ports 31 to 34 will be referred to as a first pattern or a first position.

Note that the conditions in which all inlet ports 31 to 34 are closed include not only the condition in which the opening area of each of inlet ports 31 to 34 is zero. These conditions also include the conditions in which the opening area of each of inlet ports 31 to 34 is the minimum value greater than zero, in other words, the conditions in which the cooling water slightly leaks from inlet ports 31 to 34.

When the rotor angle is increased to greater than the angle at which all inlet ports 31 to 34 are closed, third inlet port 33 connected to the outlet of the heater-core cooling liquid line opens to a predetermined extent.

The position at which third inlet port 33 opens will be referred to as a second pattern or a second position.

The predetermined extent of opening of third inlet port 33 in the second pattern is preset to a medium opening area that is smaller than the maximum opening area of third inlet port 33 so as to accord with the second pattern, and is the maximum extent of opening in the second pattern.

When the rotor angle is increased to greater than the angle at which third inlet port 33 is opened to the predetermined extent, first inlet port 31 connected to the outlet of the block cooling liquid line starts to open. The opening area of first inlet port 31 gradually increases as the rotor angle increases.

The position at which first inlet port 31 opens will be referred to as a third pattern or a third position.

When the rotor reaches the angular position at which the rotor angle is greater than when first inlet port 31 starts to open, second inlet port 32 connected to the outlet of the power-transmission-system cooling liquid line opens to a predetermined extent.

The position at which second inlet port 32 opens will be referred to as a fourth pattern or a fourth position.

The predetermined extent of opening of second inlet port 32 in the fourth pattern is preset to a medium opening area that is smaller than the maximum opening area of second inlet port 32 so as to accord with the fourth pattern, and is the maximum extent of opening in the fourth pattern.

When the rotor reaches the angular position at which the rotor angle is greater than when second inlet port 32 opens to the predetermined extent, fourth inlet port 34 connected to the outlet of the radiator cooling liquid line starts to open. The opening area of fourth inlet port 34 gradually increases as the rotor angle increases.

The position at which fourth inlet port 34 opens will be referred to as a fifth pattern or a fifth position.

The opening area of fourth inlet port 34 is set smaller than the opening area of first inlet port 31 at the start of opening, and gradually increases to greater than the opening area of first inlet port 31 as the rotor angle increases.

Next, the control exemplified in FIG. 2, i.e. the control that electronic control device 100 performs on flow rate control valve 30 during the operation of internal combustion engine 10, will be briefly described.

During the operation of internal combustion engine 10, electronic control device 100 controls the rotor angle of flow rate control valve 30 on the basis of the measurement outputs of first and second temperature sensors 81 and 82, in other words, the temperatures of cylinder head 11 and cylinder block 12.

At the cold start of internal combustion engine 10, electronic control device 100 controls flow rate control valve 30 so as to cause its rotor angle to correspond to the position (first pattern or first position) at which all inlet ports 31 to 34 are closed. This causes the cooling water to circulate by way of the bypass line, and thus warms up cylinder head 11.

Assume here that, at time point t1, the cooling water temperature TW1 at the outlet of cylinder head 11, which is measured by first temperature sensor 81, reaches a temperature that indicates that the warm-up of cylinder head 11 is completed. In response, electronic control device 100 increases the rotor angle till the rotor reaches the angular position (second pattern or second position) at which the heater-core cooling liquid line opens, thereby starting the cooling water supply to heater core 91.

Assume here that, then at time point t2, the cooling water temperature TW2 at the outlet of cylinder block 12, which is measured by second temperature sensor 82, also reaches a preset temperature. In response, electronic control device 100 increases the rotor angle till the rotor reaches the angular position (third pattern or third position) at which the block cooling liquid line opens, thereby starting the cooling water supply to cylinder block 12.

Assume that, at time point t4, the cooling water temperature TW2 at the outlet of cylinder block 12 increases by a predetermined temperature from the start of the cooling water supply to cylinder block 12, and thus reaches approximately a target temperature. In response, electronic control device 100 increases the rotor angle till the rotor reaches the angular position (fourth pattern or fourth position) at which the power-transmission-system cooling liquid line opens, thereby starting the cooling water supply to oil warmer 21.

Upon the completion of the warm-up of the components of internal combustion engine 10, electronic control device 100 increases the rotor angle till the rotor reaches the angular position (fifth pattern or fifth position) at which the radiator cooling liquid line opens. Thereafter, electronic control device 100 adjusts the opening area of the radiator cooling liquid line in accordance with an increase in the cooling water temperature so as to maintain the cooling water temperature at the outlet of cylinder head 11 at approximately a target value, while maintaining the cooling water temperature at the outlet of cylinder block 12 at a target value that is higher than the target value for cylinder head 11.

Thus, electronic control device 100 adjusts the temperatures of cylinder head 11 and cylinder block 12 by increasing the rotor angle of flow rate control valve 30 along with the progression of the warm-up of internal combustion engine 10, and by adjusting the opening area of the radiator cooling liquid line after the completion of the warm-up.

In other words, since the required supply rates of the cooling water to the cooling liquid lines change along with the progression of the warm-up of internal combustion engine 10, the correspondence between the rotor angle of flow rate control valve 30 and the opening areas of inlet ports 31 to 34 are appropriately set so as to allow the control characteristics of flow rate control valve 30 to change in accordance with the changes in the required supply rates.

In controlling flow rate control valve 30, electronic control device 100 prioritizes maintaining the cooling water temperature TW1 at the outlet of cylinder head 11 at approximately its target value over maintaining the cooling water temperature TW2 at the outlet of cylinder block 12 at its target value.

When, for example, internal combustion engine 10 operates at a high load, the cooling water temperature TW1 at the outlet of cylinder head 11 might be higher than its target value with the cooling water temperature TW2 at the outlet of cylinder block 12 maintained approximately at its target value. In this case, electronic control device 100 performs control for increasing the opening area of the radiator cooling liquid line. Such a control corresponds to that after time point t5 of FIG. 2.

Accordingly, when internal combustion engine 10 operates at a high load, there might occur the case in which the cooling water temperature TW1 at the outlet of cylinder head 11 maintained at approximately at its target value while the cooling water temperature TW2 at the outlet of cylinder block 12 is reduced below its target value.

Figure 3:
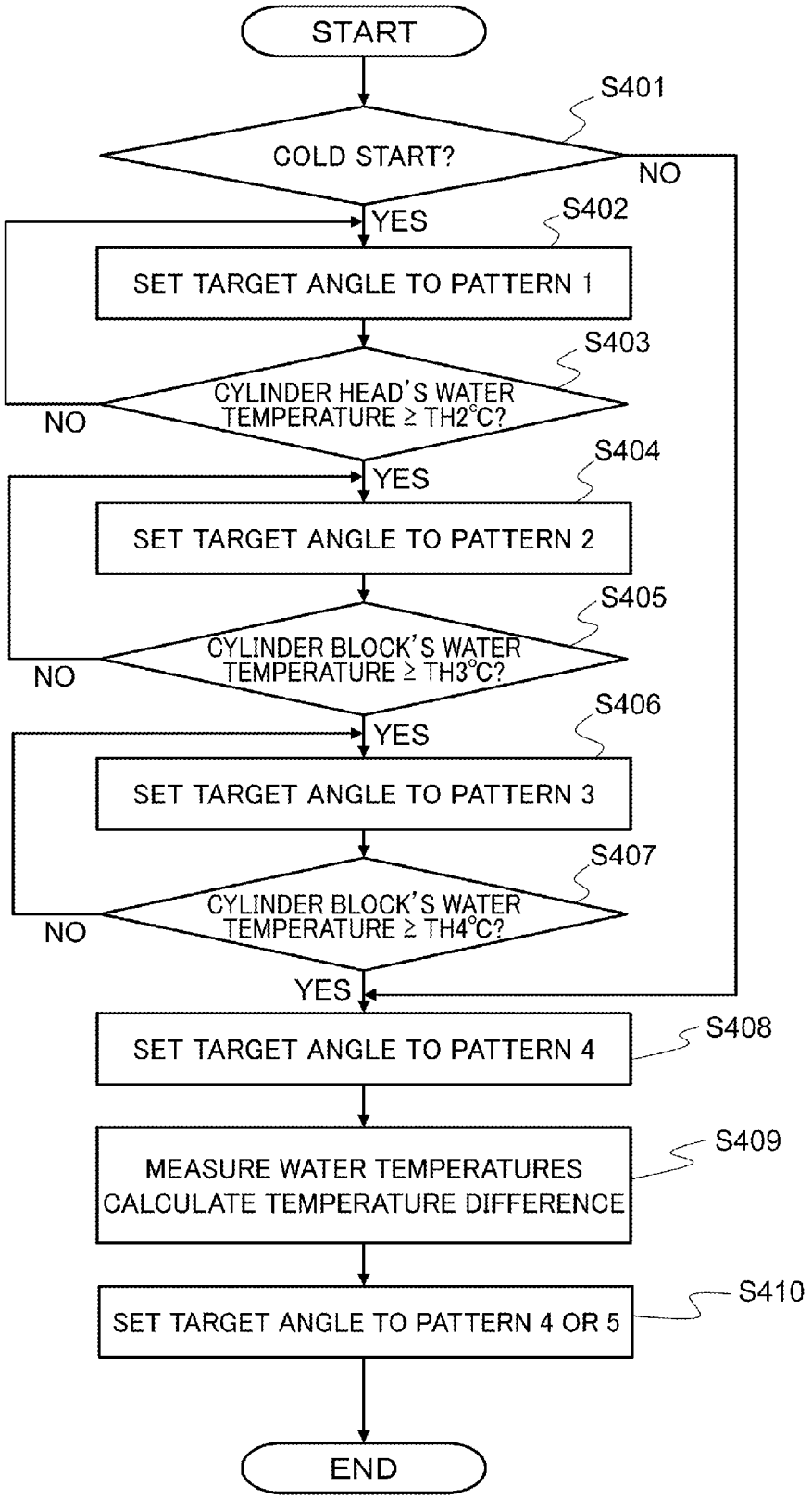
FIG. 3 is a flowchart exemplifying the control of the flow rate control valve during the operation of the internal combustion engine, according to the embodiment of the present invention.

The flowchart of FIG. 3 represents an example of the control that electronic control device 100 performs on flow rate control valve 30 during the operation of internal combustion engine 10. Electronic control device 100 conducts the routine represented in the flowchart of FIG. 3 as interrupt processing performed with predetermined time intervals.

First, in step S401, by comparing a first threshold TH1 with the measurement signal TW1 outputted by first temperature sensor 81, that is, the water temperature TW1 at the outlet of cylinder head 11, electronic control device 100 determines whether internal combustion engine 10 is started up from cold start or restarted just after being stopped operating, that is, started at a high temperature.

When electronic control device 100 determines that internal combustion engine 10 is started up from cold start where the water temperature TW1 at the outlet of cylinder head 11 is below the first threshold TH1, the operation proceeds to step S402.

On the other hand, when electronic control device 100 determines that internal combustion engine 10 is restarted from the warmed-up condition in which the water temperature TW1 at the outlet of cylinder head 11 is not less than the first threshold TH1, the operation skips steps S402 to S407, and proceeds to step S408.

When determining that internal combustion engine 10 is at cold start, electronic control device 100 sets a target rotor angle for flow rate control valve 30 to the first pattern (first position) in the next step S402.

In other words, in step S402, electronic control device 100 sets the target rotor angle to an angle at which all first to fourth inlet ports 31 to 34 are closed.

This target angle setting stops the cooling water circulation by way of first to fourth inlet ports 31 to 34. Thereby, the cooling water discharged from mechanical water pump 45 circulates through the route by which the cooling water flows through seventh cooling water pipe 77, cooling water passage 61, first cooling water pipe 71 and eighth cooling water pipe 78, and returns to be drawn into mechanical water pump 45.

By controlling flow rate control valve 30 at the first pattern (first position), electronic control device 100 accelerates the temperature rise in cylinder head 11 and achieves quicker improvement of the combustibility of internal combustion engine 10 so as to improve its fuel economy.

Under the condition in which electronic control device 100 controls flow rate control valve 30 according to the first pattern, the operation proceeds to step S403, in which electronic control device 100 compares a second threshold TH2 with the measurement signal TW1 outputted by first temperature sensor 81, that is, the water temperature TW1 at the outlet of cylinder head 11.

Here, the second threshold TH2 is set to a temperature higher than the first threshold TH1. Specifically, the second threshold TH2 is set to an appropriate value ensuring that the temperature of cylinder head 11 increases enough to allow internal combustion engine 10 to provide sufficient combustibility, in other words, ensuring that the warm-up of cylinder head 11 is completed.

The second threshold TH2 is set to a temperature approximately between 80° C. and 100° C.

When electronic control device 100 determines that the water temperature TW1 at the outlet of cylinder head 11 does not reach the second threshold TH2, the operation returns to step S402, in which electronic control device 100 continues to control flow rate control valve 30 according to the first pattern.

In other words, when the temperature of cylinder head 11 is not increased enough to allow internal combustion engine 10 to provide sufficient combustibility, electronic control device 100 controls flow rate control valve 30 at the first pattern (first position) so as to accelerate the temperature rise in cylinder head 11.

When the water temperature TW1 at the outlet of cylinder head 11 reaches the second threshold TH2 so that the warm-up of cylinder head 11 is completed, the operation of electronic control device 100 proceeds to step S404.

In step S404, electronic control device 100 sets the target rotor angle for flow rate control valve 30 to the second pattern (second position).

In other words, in step S404, electronic control device 100 sets the target rotor angle to an angle corresponding to the angular position at which third inlet port 33 opens while first, second and fourth inlet ports 31, 32 and 34 are maintained to be closed.

Setting the rotor angle of flow rate control valve 30 to the second pattern (second position) makes the cooling water circulation by way of third inlet port 33 started while continuing to stop the cooling water circulation by way of first, second and fourth inlet ports 31, 32 and 34.

Thereby, some of the cooling water discharged from mechanical water pump 45 starts to circulate through the route by which the cooling water flows through seventh cooling water pipe 77, cooling water passage 61, fourth cooling water pipe 74, flow rate control valve 30 and sixth cooling water pipe 76, and returns to be drawn into mechanical water pump 45. Meanwhile, another some of the cooling water discharged from cooling water passage 61 circulates through first cooling water pipe 71 and eighth cooling water pipe 78.

Diverting some of the cooling water having passed through cylinder head 11 to fourth cooling water pipe 74 allows the diverted cooling water to exchange heat with heater core 91, EGR cooler 92, exhaust gas recirculation control valve 93 and throttle valve 94 disposed on fourth cooling water pipe 74.

In addition, when the rotor angle of flow rate control valve 30 is set to the second pattern (second position), the cooling water circulates through the routes each of which bypasses radiator 50 without flowing through second cooling water pipe 72 into cylinder block 12 that has not sufficiently warmed up and without flowing through oil warmer 21 disposed on third cooling water pipe 73. Thus, the cooling water can be maintained at a high temperature.

This allows the cooling water at a sufficiently high temperature to be supplied to fourth cooling water pipe 74 on which the heater devices such as heater core 91 are disposed, thus allowing for the quicker response of the air heating that uses heat exchange in heater core 91.

In the second pattern setting, along with the progression of the warm-up of internal combustion engine 10, electronic control device 100 incrementally increases the target rotor angle for flow rate control valve 30 to increase the opening area of third inlet port 33. Thereby, electronic control device 100 maintains the water temperature TW1 at the outlet of cylinder head 11 at approximately the second threshold TH2.

In addition, electronic control device 100 increases the opening area of third inlet port 33 till the rotor angle of flow rate control valve 30 reaches the upper limit for the second pattern by increasing the rotor angle just before the rotor reaches the angular position of switching to the third pattern (third position).

Under the conditions in which electronic control device 100 sets the rotor angle of flow rate control valve 30 to the second pattern (second position) so as to circulate the cooling water by way of heater core 91, the operation proceeds to step S405. In step S405, electronic control device 100 compares a third threshold TH3 with the measurement signal TW2 outputted by second temperature sensor 82, that is, the water temperature TW2 at the outlet of cylinder block 12.

The third threshold TH3 is set to a temperature equal to the second threshold TH2, or a temperature higher or lower than the second threshold TH2 by a predetermined temperature difference.

By comparing the third threshold TH3 with the water temperature TW2 at the outlet of cylinder block 12, electronic control device 100 detects whether the temperature of cylinder block 12 reaches the temperature for starting the cooling water supply to cylinder block 12, in other words, whether the warm-up of cylinder block 12 is completed.

While the water temperature TW2 at the outlet of cylinder block 12 is below the third threshold TH3, that is, during the warm-up of cylinder block 12, the operation returns to step S404, in which electronic control device 100 continues to set the rotor angle of flow rate control valve 30 to the second pattern.

On the other hand, when the water temperature TW2 at the outlet of cylinder block 12 becomes not less than the third threshold TH3, the operation of electronic control device 100 proceeds to step S406.

In step S406, electronic control device 100 sets the target rotor angle for flow rate control valve 30 to the third pattern (third position).

In other words, in step S406, electronic control device 100 sets the target rotor angle to an angle corresponding to the angular position at which first inlet port 31 opens while second and fourth inlet ports 32 and 34 are maintained to be closed and the opening area of third inlet port 33 is maintained at the upper limit.

This target angle setting makes the cooling water circulation by way of first inlet port 31 started while continuing to stop the cooling water circulation by way of second and fourth inlet ports 32 and 34 and while maintaining the cooling water circulation by way of third inlet port 33.

Thereby, some of the cooling water discharged from mechanical water pump 45 starts to circulate through the route by which the cooling water flows through cooling water passage 62, second cooling water pipe 72, flow rate control valve 30 and sixth cooling water pipe 76 and returns to be drawn into mechanical water pump 45.

As a result, some of the cooling water discharged from mechanical water pump 45 is supplied to cylinder block 12 so as to control the temperature of cylinder block 12.

In the third pattern setting, along with an increase in the water temperature TW2 at the outlet of cylinder block 12, electronic control device 100 incrementally increases the target rotor angle for flow rate control valve 30 to increase the opening area of first inlet port 31.

Note that, in the third pattern, electronic control device 100 increases the opening area of first inlet port 31 till the rotor angle of flow rate control valve 30 reaches the upper limit for the third pattern by increasing the rotor angle just before the rotor reaches the angular position of switching to the fourth pattern.

By controlling the cooling water supply to cylinder block 12 through the control on flow rate control valve 30 according to the third pattern, electronic control device 100 gradually increases the temperature of cylinder block 12 to its target value while preventing the temperature of cylinder block 12 from overshooting beyond its target value.

Under the conditions in which electronic control device 100 controls flow rate control valve 30 according to the third pattern so as to circulate the cooling water by way of cylinder block 12, the operation proceeds to step S407. In step S407, electronic control device 100 compares the fourth threshold TH4 with the measurement signal TW2 outputted by second temperature sensor 82, that is, the water temperature TW2 at the outlet of cylinder block 12.

The fourth threshold TH4 is a target temperature for cylinder block 12, and set to a value that is higher than the second threshold TH2, which is the target temperature for cylinder head 11, and that is higher than the third threshold TH3 for starting the cooling water supply to cylinder block 12. For example, the fourth threshold TH4 is set to a value approximately between 100° C. and 110° C.

In other words, the target temperature for cylinder block 12 is set with the aim of reducing friction therein, while the target temperature for cylinder head 11 is set with the aim of reducing pre-ignition and knocking. Thus, the target temperature for cylinder block 12 is set higher than the target temperature for cylinder head 11 so as to more effectively reduce friction in cylinder block 12.

When the water temperature TW2 at the outlet of cylinder block 12 is below the fourth threshold TH4, the operation returns to step S406, in which electronic control device 100 continues to control flow rate control valve 30 according to the third pattern.

On the other hand, when the water temperature TW2 at the outlet of cylinder block 12 reaches the fourth threshold TH4, which is the target temperature for cylinder block 12, the operation of electronic control device 100 proceeds to step S408.

In step S408, electronic control device 100 sets the target rotor angle for flow rate control valve 30 to the fourth pattern.

In other words, in step S408, electronic control device 100 sets the target rotor angle to an angle corresponding to the angular position at which the opening area of second inlet port 32 reaches the upper limit, while fourth inlet port 34 is maintained to be closed, the opening area of third inlet port 33 is maintained at the upper limit, and the opening area of first inlet port 31 continues to increase as in the previous third pattern.

Under the condition in which the rotor angle of flow rate control valve 30 is set to the fourth pattern, the cooling water supply to the fourth cooling liquid line is started, while the cooling water circulation by way of radiator 50 still continues to be stopped as in the preceding first to third patterns. As a result, the cooling water is supplied to cylinder block 12 through the second cooling liquid line, to heater core 91 through the third cooling liquid line, to oil warmer 21 through the fourth cooling liquid line, and to the bypass line.

In addition, by opening second inlet port 32, the cooling water having passed through cylinder head 11 is partially diverted to fourth cooling water pipe 74, so that the diverted cooling water circulates through the route by which the cooling water flows through fourth cooling water pipe 74 to flow rate control valve 30 by way of oil warmer 21, and returns to be drawn into mechanical water pump 45.

Thereby, oil warmer 21 exchanges heat between the hydraulic oil of transmission 20 and the cooling water, thereby accelerating the warm up of transmission 20.

After electronic control device 100 starts to control flow rate control valve 30 according to the fourth pattern in step S408, the operation proceeds to step S409. In step S409, electronic control device 100 calculates a difference ΔTC between the fourth threshold TH4 and the water temperature TW2 at the outlet of cylinder block 12 as well as a difference ΔTB between the second threshold TH2 and the water temperature TW1 at the outlet of cylinder head 11.

Then, the operation proceeds to step S410, in which electronic control device 100 performs switching control of flow rate control valve 30 on the basis of the temperature differences ΔTC and ΔTB calculated in step S409.

Specifically, electronic control device 100 performs this switching control as follows. When the load on internal combustion engine 10 increases, and, consequently, the water temperature TW2 at the outlet of cylinder block 12 and/or the water temperature TW1 at the outlet of cylinder head 11 become higher than their target values by not less than predetermined values, electronic control device 100 sets the target rotor angle for flow rate control valve 30 to the fifth pattern. When the load on internal combustion engine 10 decreases, electronic control device 100 switches the target rotor angle back to the fourth pattern.

When the water temperature TW2 and/or the water temperature TW1 become higher than their target values by not less than the predetermined values, electronic control device 100 sets the target rotor angle to an angle corresponding to the angular position at which second and third inlet ports 32 and 33 open to the predetermined extents while the opening area of each of first and fourth inlet ports 31 and 34 increases as compared to those in the fourth pattern.

The target angle setting according to the fifth pattern changes the cooling water circulation from that bypassing radiator 50 to that allowing some of the cooling water to circulate by way of radiator 50.

Since the cooling water releases heat while flowing through radiator 50, the cooling water becomes more able to cool internal combustion engine 10, thus preventing the overheating of internal combustion engine 10.

As describe above, in the fifth pattern, electronic control device 10 controls the rotor angle of flow rate control valve 30 so as to maintain the water temperature TW2 at the outlet of cylinder block 12 at approximately its target temperature while maintaining the water temperature TW1 at the outlet of cylinder head 11 at approximately its target temperature. Note, however, that, under high load conditions, electronic control device 10 prioritizes the suppressing of the temperature rise in cylinder head 11. Specifically, electronic control device 10 increases the opening area of fourth inlet port 34 when the temperature of cylinder head 11 is higher than its target value by not less than the predetermined value, even though this control is expected to lower the temperature of cylinder block 12 below its target value.

Thereby, while internal combustion engine 10 operates in a high load range, the temperature rise in cylinder head 11 can be sufficiently suppressed so that pre-ignition and knocking can be reduced. This makes it possible to reduce an amount of correcting a retarded degree of ignition timing for reducing pre-ignition and knocking, thus reducing degradation in the output performance of internal combustion engine 10.

Hereinafter, description will be given of an example of control that electronic control device 100 performs on flow rate control valve 30 and electric water pump 40 while internal combustion engine 10 is temporarily stopped by idle reduction control.

Electronic control device 100 has an idle reduction function of automatically stopping the operation of internal combustion engine 10 while, for example, the vehicle waits for a traffic light. Also, electronic control device 100 has a function of, while internal combustion engine 10 is temporarily stopped by idle reduction control, causing electric water pump 40 to operate so as to circulate the cooling water in internal combustion engine 10, and adjusting the supply rates of the cooling water to the multiple cooling liquid lines by controlling the rotor angle of flow rate control valve 30.

Note that a temporary stop condition of internal combustion engine 10 is not limited to temporary stop by the idle reduction control, but includes the condition in which internal combustion engine 10 is automatically stopped when, for example, the drive source is switched therefrom in a hybrid vehicle.

Figure 4:
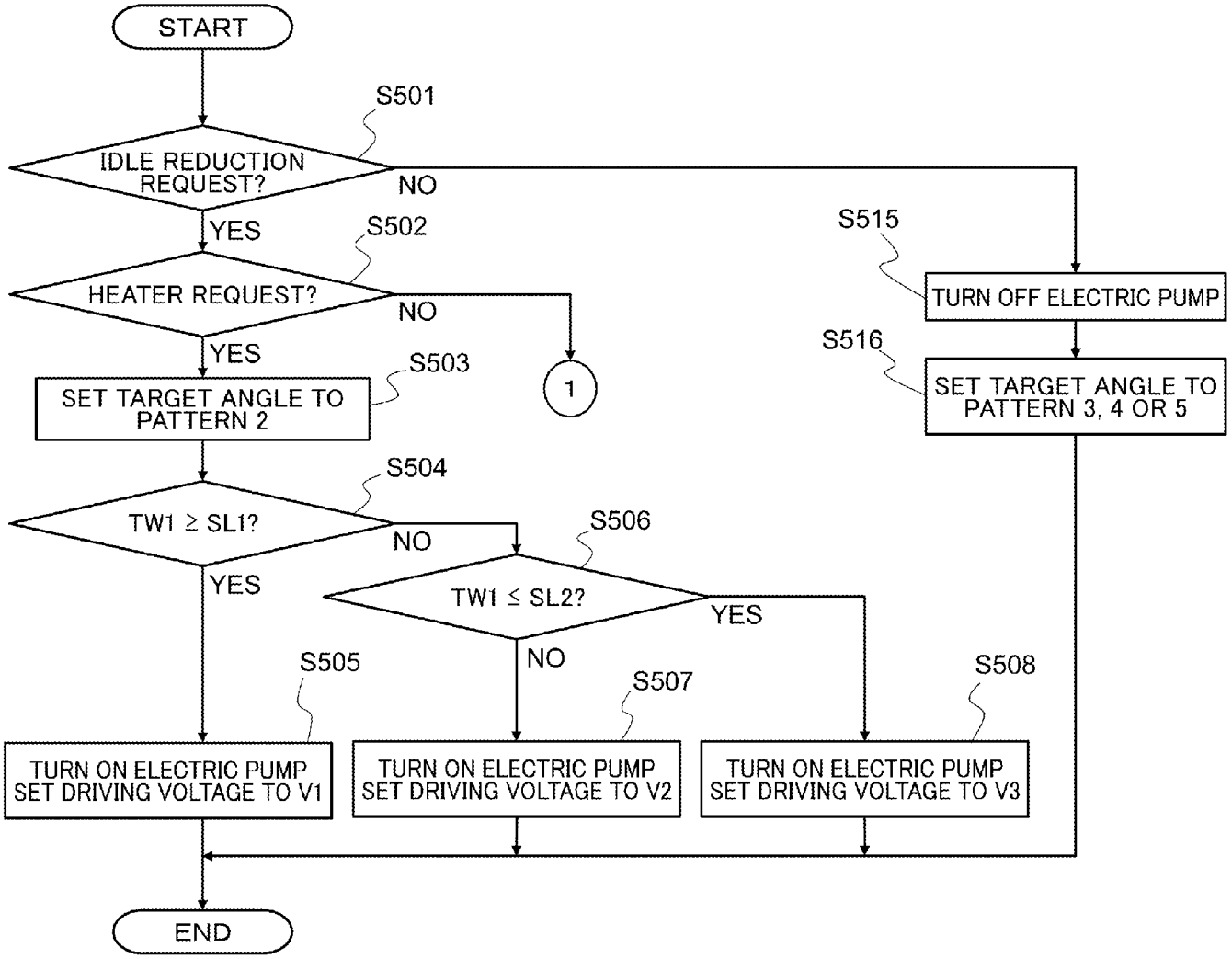
FIG. 4 is a flowchart exemplifying control of the flow rate control valve and an electric water pump during idle reduction, according to the embodiment of the present invention.
Figure 5:
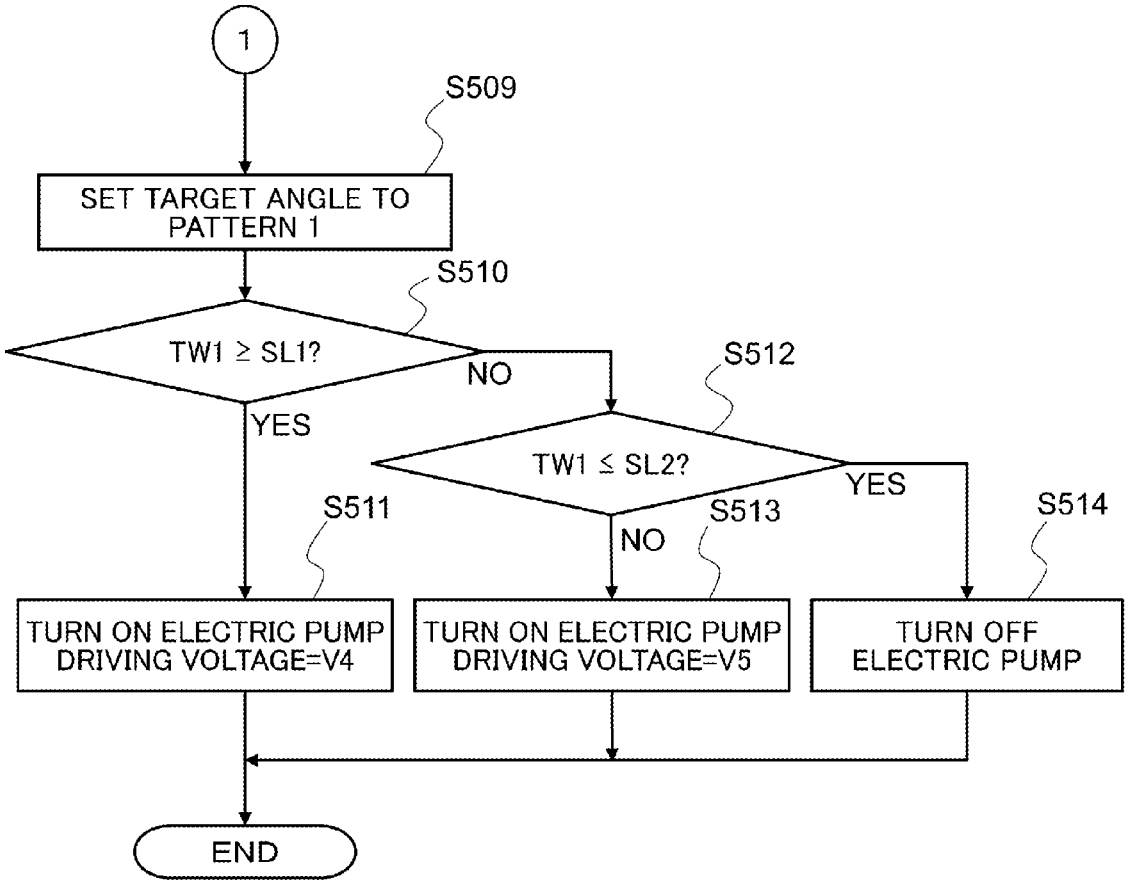
FIG. 5 is a flowchart exemplifying the control of the flow rate control valve and the electric water pump during idle reduction, according to the embodiment of the present invention.

The flowcharts of FIGS. 4 and 5 represent an example of the control that electronic control device 100 performs on electric water pump 40 and flow rate control valve 30 during the temporary stop of internal combustion engine 10. Electronic control device 100 conducts the routine represented in the flowcharts of FIGS. 4 and 5 as interrupt processing with predetermined time intervals.

In step S501, electronic control device 100 detects whether or not there is a request for the idle reduction control to automatically stop internal combustion engine 10. In other words, electronic control device 100 detects whether or not variables, such as the load and the rotation speed of internal combustion engine 10 and the operation status of the brake, satisfy the conditions for automatically stopping internal combustion engine 10 through the idle reduction control.

When determining that there is an idle reduction request, the operation proceeds to step S502, in which electronic control device 100 then determines whether or not it is requested to heat air for air-conditioning by using the cooling water for internal combustion engine 10 in heater core 91.

Electronic control device 100 detects whether or not it is requested to heat air for air-conditioning in heater core 91 on the basis of air-conditioning conditions such as a set blower's air volume and a set air-conditioning temperature in the air conditioner, and an outside air temperature.

For example, electronic control device 100 can detect that it is requested to heat air for air-conditioning in heater core 91 when the blower's air volume is larger than a predetermined air volume and the set air-conditioning temperature is higher than a predetermined temperature, and when the blower's air volume is larger than a predetermined air volume and the outside air temperature is below a predetermined temperature.

Here, electronic control device 100 can acquire information such as the blower's air volume from an air conditioning control unit connected to electronic control device 100 via a controller area network (CAN). Also, electronic control device 100 can acquire, from the air conditioning control unit, a signal indicating whether or not it is requested to heat air for air-conditioning in heater core 91.

Electronic control device 100 may be configured to directly receive output signals such as a signal outputted by a temperature setting switch of the air conditioner, and a signal outputted by an outside-air temperature sensor.

When determining that it is requested to heat air for air-conditioning in heater core 91, the operation proceeds to step S503, in which electronic control device 100 controls the rotor angle of flow rate control valve 30 at an angle that opens the heater-core cooling liquid line while closing the other cooling liquid lines, i.e. the radiator cooling liquid line, the block cooling liquid line, the power-transmission-system cooling liquid line.

In other words, in step S503, electronic control device 100 controls the rotor angle of flow rate control valve 30 so as to cause the cooling water having passed through cylinder head 11 to flow through two separate routes: the route passing through the bypass line while bypassing radiator 50, and the route by way of heater core 91 and flow rate control valve 30, and then to be merged in sixth cooling water pipe 76 to be supplied again to cylinder head 11.

In other words, when it is requested to heat air for air-conditioning in heater core 91 during the temporary stop of internal combustion engine 10 in the middle of its operation, electronic control device 100 controls the rotor angle of flow rate control valve 30 so as to maintain the supply rate of the cooling water to the heater-core cooling liquid line at a level equivalent to that before the temporary stop by reducing the supply rates of the cooling water to the radiator cooling liquid line, the block cooling liquid line and the power-transmission-system cooling liquid line as compared to those before the temporary stop.

Then, the operation proceeds to step S504, in which electronic control device 100 detects whether or not the cooling water temperature TW1 at the outlet of cylinder head 11 determined from the output signal from first temperature sensor 81 is not less than a first set temperature SL1.

For example, the first set temperature SL1 is approximately 90° C.

When determining that the temperature TW1 is not less than the first set temperature SL1, the operation proceeds to step S505, in which electronic control device 100 supplies power to electric water pump 40 with a drive voltage for electric water pump 40 set to a predetermined first voltage V1.

During the temporary stop of internal combustion engine 10, mechanical water pump 45 is stopped. However, the cooling water can be circulated in internal combustion engine 10 even during the stop of internal combustion engine 10 by causing electric water pump 40 to operate.

Here, the rotor angle of flow rate control valve 30 is controlled at an angle that opens the heater-core cooling liquid line while closing the other cooling liquid lines through the control of step S503. This causes the cooling water having passed through cylinder head 11 to flow through the two separate routes, that is, the route passing through the bypass line while bypassing radiator 50, and the route by way of heater core 91 and flow rate control valve 30.

The cooling water having passed through eighth cooling water pipe 78 in the bypass line is drawn into electric water pump 40 and pumped out again toward cooling water passage 61 in cylinder head 11. Then, the cooling water pumped out of electric water pump 40 is mixed with the cooling water having passed through fourth cooling water pipe 74 on which heater core 91 is disposed and through mechanical water pump 45, and supplied again to cooling water passage 61 in cylinder head 11.

When electronic control device 100 determines that the cooling water temperature TW1 is less than the first set temperature SL1 in step S504, the operation proceeds to step S506. In step S506, electronic control device 100 detects whether or not the cooling water temperature TW1 is not more than a second set temperature SL2.

The second set temperature SL2 is lower than the first set temperature SL1, and may be set to approximately 70° C., for example.

When electronic control device 100 determines that the cooling water temperature TW1 is less than the first set temperature SL1 but more than the second set temperature SL2, the operation proceeds to step S507. In step S507, electronic control device 100 supplies power to electric water pump 40 with the drive voltage for electric water pump 40 set to a predetermined second voltage V2.

The second voltage V2 is lower than the first voltage V1, so that the discharge rate of electric water pump 40 while being driven at the second voltage V2 is less than that while being driven at the first voltage V1.

When electronic control device 100 determines that the cooling water temperature TW1 is not more than the second set temperature SL2, the operation proceeds to step S508. In step S508, electronic control device 100 supplies power to electric water pump 40 with the drive voltage for electric water pump 40 set to a predetermined third voltage V3.

The third voltage V3 is less than the second voltage V2, so that the discharge rate of electric water pump 40 while being driven at the third voltage V3 is less than that while being driven at the second voltage V2. In other words, the inequality "third voltage V3<second voltage V2<first voltage V1" holds, and thus the discharge rate of electric water pump 40 becomes the minimum when the third voltage V3 is applied thereto, and becomes the maximum when the first voltage V1 is applied.

Here, electronic control device 100 controls the drive voltage for electric water pump 40 with the aim of reducing the cooling water temperature TW1 to not more than the second set temperature SL2, which is less than the first set temperature SL1.

When the cooling water temperature TW1 is not less than the first set temperature SL1, electronic control device 100 sets the drive voltage for electric water pump 40 to a value higher than when the cooling water temperature TW1 is less than the first set temperature SL1 so as to quickly reduce the cooling water temperature TW1 to not more than the second set temperature SL2.

When the cooling water temperature TW1 is reduced to a value that is less than the first set temperature SL1 but more than the second set temperature SL2, electronic control device 100 reduces the driving voltage for electric water pump 40 so as to gradually reduce the cooling water temperature TW1 to approximately the second set temperature SL2.

When the cooling water temperature TW1 is reduced to not more than the second set temperature SL2, electronic control device 100 further reduces the driving voltage for electric water pump 40 till its discharge rate is reduced to a value required to heat air for air-conditioning in heater core 91 so as to prevent an excessive temperature drop of cylinder head 11.

In other words, the first set temperature SL1 and the first to third voltages V1 to V3 are set to appropriate values making it possible to more responsively reduce the cooling water temperature while preventing overshooting during the control of reducing the cooling water temperature TW1 to not more than the second set temperature SL2, and to supply heater core 91 with a sufficient rate of the cooling liquid.

The second set temperature SL2, which is the target temperature for cylinder head 11, is set to an appropriated value on the basis of the maximum temperature within a range that prevents the occurrence of pre-ignition and knocking when internal combustion engine 10 is restarted.

Note that, instead of variably controlling the drive voltage for electric water pump 40, electronic control device 100 may switch between the drive and stop controls for electric water pump 40 in accordance with whether the cooling water temperature TW1 is above or below its target value. Moreover, electronic control device 100 may change the drive voltage for electric water pump 40 to a larger number of levels than in the example represented in the flowchart of FIGS. 4 and 5.

When electronic control device 100 detects that it is not requested to heat air for air-conditioning in heater core 91 in step S502, the operation proceeds to step S509.

In step S509, electronic control device 100 controls the rotor angle of flow rate control valve 30 at an angle that closes all the cooling liquid lines, i.e. the heater-core cooling liquid line, the radiator cooling liquid line, the block cooling liquid line and the power-transmission-system cooling liquid line.

When it is not requested to heat air for air-conditioning in heater core 91, the cooling water having passed through cylinder head 11 does not have to be partially diverted toward heater core 91 through the heater-core cooling liquid line. Thus, electronic control device 100 controls the rotor angle of flow rate control valve 30 so as to close all the cooling liquid lines including the heater-core cooling liquid line.

Then, the operation proceeds to step S510, in which electronic control device 100 detects whether or not the cooling water temperature TW1 is not more than the first set temperature SL1.

When electronic control device 100 detects that the cooling water temperature TW1 is not more than the first set temperature SL1, the operation proceeds to step S511. In step S511, electronic control device 100 supplies power to electric water pump 40 with the drive voltage for electric water pump 40 set to a predetermined fourth voltage V4.

Here, the fourth voltage V4 may be set to a voltage approximately equal to or less than the first voltage V1.

When electronic control device 100 detects that the cooling water temperature TW1 is less than the first set temperature SL1, the operation proceeds to step S512. In step S512, electronic control device 100 detects whether or not the cooling water temperature TW1 is not more than the second set temperature SL2.

When detecting that the cooling water temperature TW1 is less than the first set temperature SL1 but more than the second set temperature SL2, the operation proceeds to step S513. In step S513, electronic control device 100 supplies power to electric water pump 40 with the drive voltage for electric water pump 40 set to a predetermined fifth voltage V5.

The fifth voltage V5 is less than the fourth voltage V4, and may be set to a voltage approximately equal to or less than the second voltage V2.

When electronic control device 100 detects that the cooling water temperature TW1 is not more than the second set temperature SL2, the operation proceeds to step S514. In step S514, electronic control device 100 stops the power supply to electric water pump 40 so as to stop the operation of electric water pump 40.

When electronic control device 100 detects that there is no idle reduction request in step S501, in other words, detects that internal combustion engine 10 is operating and driving mechanical water pump 45, the operation proceeds to step S515. In step S515, electronic control device 100 stops the power supply to electric water pump 40 so as to stop the operation of electric water pump 40.

Then, the operation proceeds to step S516, in which, during the operation of internal combustion engine 10, electronic control device 100 controls the rotor angle of flow rate control valve 30, that is, the supply rates of the cooling water to the cooling liquid lines on the basis of the cooling water temperatures TW1 and TW2.

As described above, when internal combustion engine 10 is stopped by the idle reduction control so that the cooling water circulation by mechanical water pump 45 is stopped, electronic control device 100 drives electric water pump 40 and controls flow rate control valve 30 so as to stop the cooling water supply to the block cooling liquid line. This makes it possible to suppress the temperature rise in cylinder head 11 while preventing an excessive temperature drop of cylinder block 12.

Accordingly, internal combustion engine 10 is prevented from being restarted under the condition where the temperature of cylinder head 11 is high. Thereby, the occurrence of abnormal combustion such as pre-ignition and knocking is reduced or prevented.

This improves the startup performance of internal combustion engine 10 at the restart, and reduces a required retarded degree of ignition timing for reducing knocking, so that the output characteristics and fuel economy of internal combustion engine 10 are improved. In addition, an increase in friction due to a temperature drop of cylinder block 12 is suppressed, which also improves fuel economy.

Electronic control device 100 determines whether to supply the cooling water to heater core 91 on the basis of whether or not it is requested to heat air for air-conditioning in heater core 91, thus reducing degradation in the air-conditioning performance during idle reduction.

When it is not requested to heat air for air-conditioning in heater core 91, electronic control device 100 reduces the drive voltage for electric water pump 40 as compared to when the air heating is requested so as to suppress power consumption during idle reduction.

Note that electronic control device 100 does not have to detect whether or not it is requested to heat air for air-conditioning in heater core 91. When not conducting this detection, electronic control device 100 may perform either the processing of steps S503 to S508 or the processing of steps S509 to S514.

Incidentally, internal combustion engine 10 does not stop rotating immediately after fuel injection and ignition operation for internal combustion engine 10 is stopped in response to an idle reduction request, but gradually decreases in rotation speed because of inertial forces. Accordingly, the rotation speed of mechanical water pump 45, which is driven by internal combustion engine 10, is also gradually reduced.

Thus, the rotation speed of internal combustion engine 10 is close to an idling rotation speed immediately after the idle reduction request is generated. Under the condition, the discharge rate of mechanical water pump 45 might stay larger than the discharge rate of electric water pump 40.

The drive of electric water pump 40 under the above conditions is ineffective since it makes virtually no contribution to the cooling water circulation, thus resulting in wasteful power consumption during idle reduction.

In addition, after the rotor angle of flow rate control valve 30 is switched to the target value set for during the stop of internal combustion engine 10 in response to an idle reduction request, there is a time delay before the rotor angle of flow rate control valve 30 actually changes.

Accordingly, if electric water pump 40 is activated in synchronization with the switching of the rotor angle of flow rate control valve 30 to the target value, electric water pump 40 will be activated before the rotor angle of flow rate control valve 30 actually changes to the target value set for during the stop of internal combustion engine 10. Thus, the drive of electric water pump 40 under such a condition might be ineffective since it makes no contribution to the aim of reducing a temperature rise in cylinder head 11 during the stop of internal combustion engine 10.

In view of the above, electronic control device 100 can activate electric water pump 40 after a predetermined delay period elapses from the issue of a command to temporarily stop internal combustion engine 10.

Figure 6:
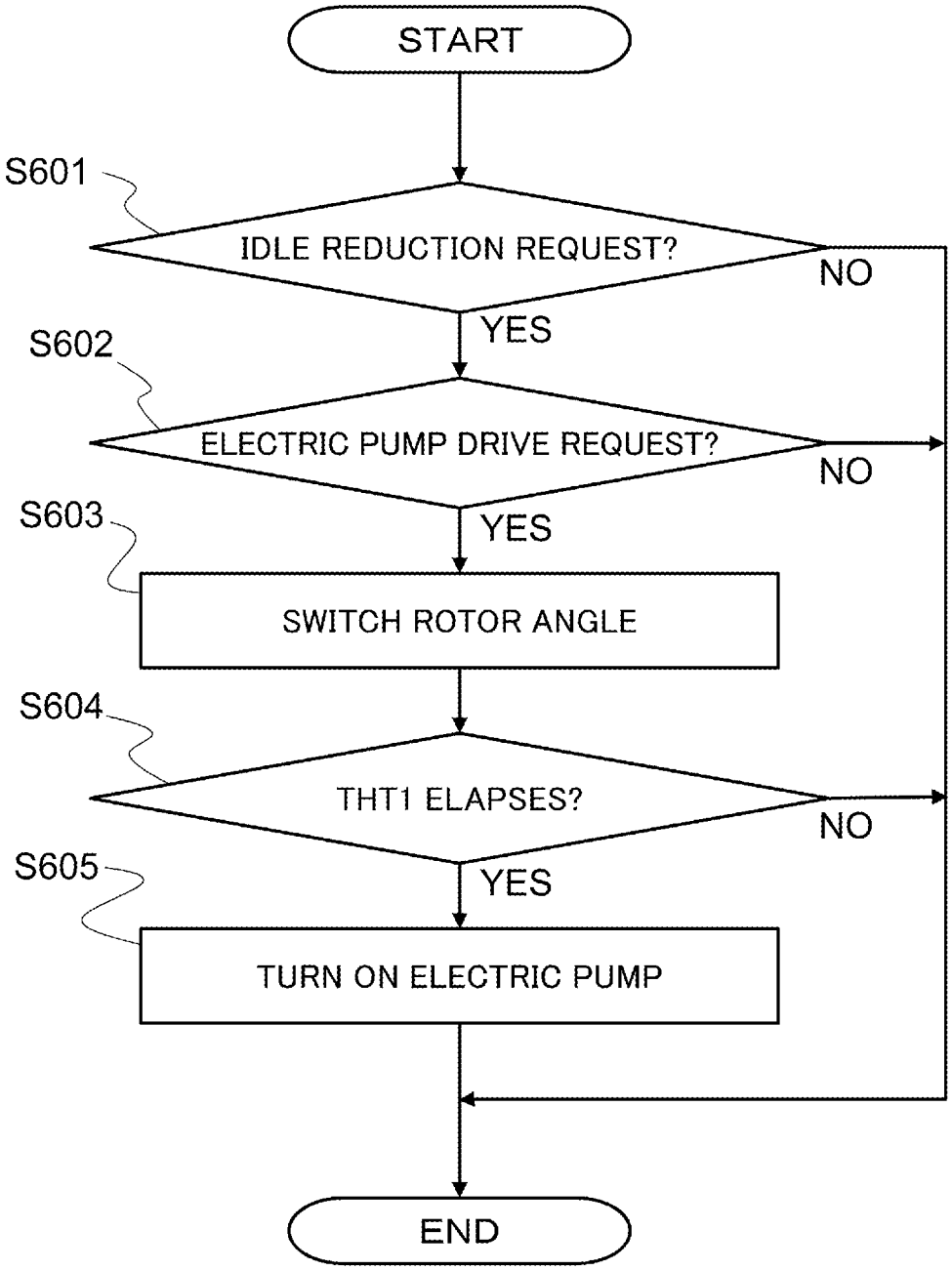
FIG. 6 is a flowchart exemplifying activation control of the electric water pump during idle reduction, according to the embodiment of the present invention.

The flowchart of FIG. 6 represents an example of processing for delaying the activation of electric water pump 40, which is performed by electronic control device 100.

Electronic control device 100 detects whether or not there is an idle reduction request in step S601. When electronic control device 100 determines that there is no idle reduction request, that is, that internal combustion engine 10 is operating, this routine ends before the processing for driving electric water pump 40 is performed. Thereby, electronic control device 100 keeps electric water pump 40 stopped.

On the other hand, when determining that there is an idle reduction request, the operation proceeds to step S602, in which electronic control device 100 detects whether or not there is a drive request for electric water pump 40.

A drive request for electric water pump 40 is determined to be issued when the conditions that cause electronic control device 100 to perform the processing in step S505, S507, S508, S511 or S513 of FIGS. 4 and 5 are satisfied.

When electronic control device 100 determines that there is a drive request for electric water pump 40, the operation proceeds to step S603. In step S603, electronic control device 100 changes the target rotor angle of flow rate control valve 30 from that for during the operation of internal combustion engine 10 to that for during the temporary stop of internal combustion engine 10.

The target rotor angle during the operation of internal combustion engine 10 is determined in step S516 of the flowchart of FIG. 4, while the target rotor angle during the temporary stop of internal combustion engine 10 is determined in step S503 or S509.

Then, the operation proceeds to step S504, in which electronic control device 100 detects whether or not a time elapses from the rising of the idle reduction request reaches a predetermined time THT1.

When electronic control device 100 detects that the time elapses from the rising of the idle reduction request is less than the predetermined time THT1, step S604 is skipped and this routine ends. Thereby, electronic control device 100 keeps electric water pump 40 stopped without driving it.

When electronic control device 100 detects that the time elapses from the rising of the idle reduction request reaches the predetermined time THT1, the operation proceeds to step S605, in which electronic control device 100 starts power supply to electric water pump 40.

The predetermined time THT1 is preset to an appropriate time on the basis of a time required for internal combustion engine 10 to be reduced in rotation speed enough to reduce the discharge rate of mechanical water pump 45 to below a set discharge rate of electric water pump 40 and/or a time required for flow rate control valve 30 to rotate till the rotor angle becomes the target angle for during the temporary engine stop.

For example, when the time required for mechanical water pump 45 to reduce its discharge rate to below the set discharge rate of electric water pump 40 is longer than the time required for flow rate control valve 30 to rotate till the rotor angle becomes the target angle for during the temporary engine stop, the predetermined time THT1 is set to the time required for mechanical water pump 45 to reduce its discharge rate to below the set discharge rate of electric water pump 40.

This prevents electric water pump 40 from being activated while the discharge rate of mechanical water pump 45 is more than that of electric water pump 40, and prevents electric water pump 40 from being activated before the rotor angle of flow rate control valve 30 reaches the target angle for during the temporary engine stop. As a result, wasteful power consumption is reduced during the stop of internal combustion engine 10.

In addition, activating electric water pump 40 before the rotation stop of mechanical water pump 45 prevents a reduction in the circulation rate of the cooling water, thus reducing degradation in cooling performance at the time of stopping internal combustion engine 10.

Figure 7:
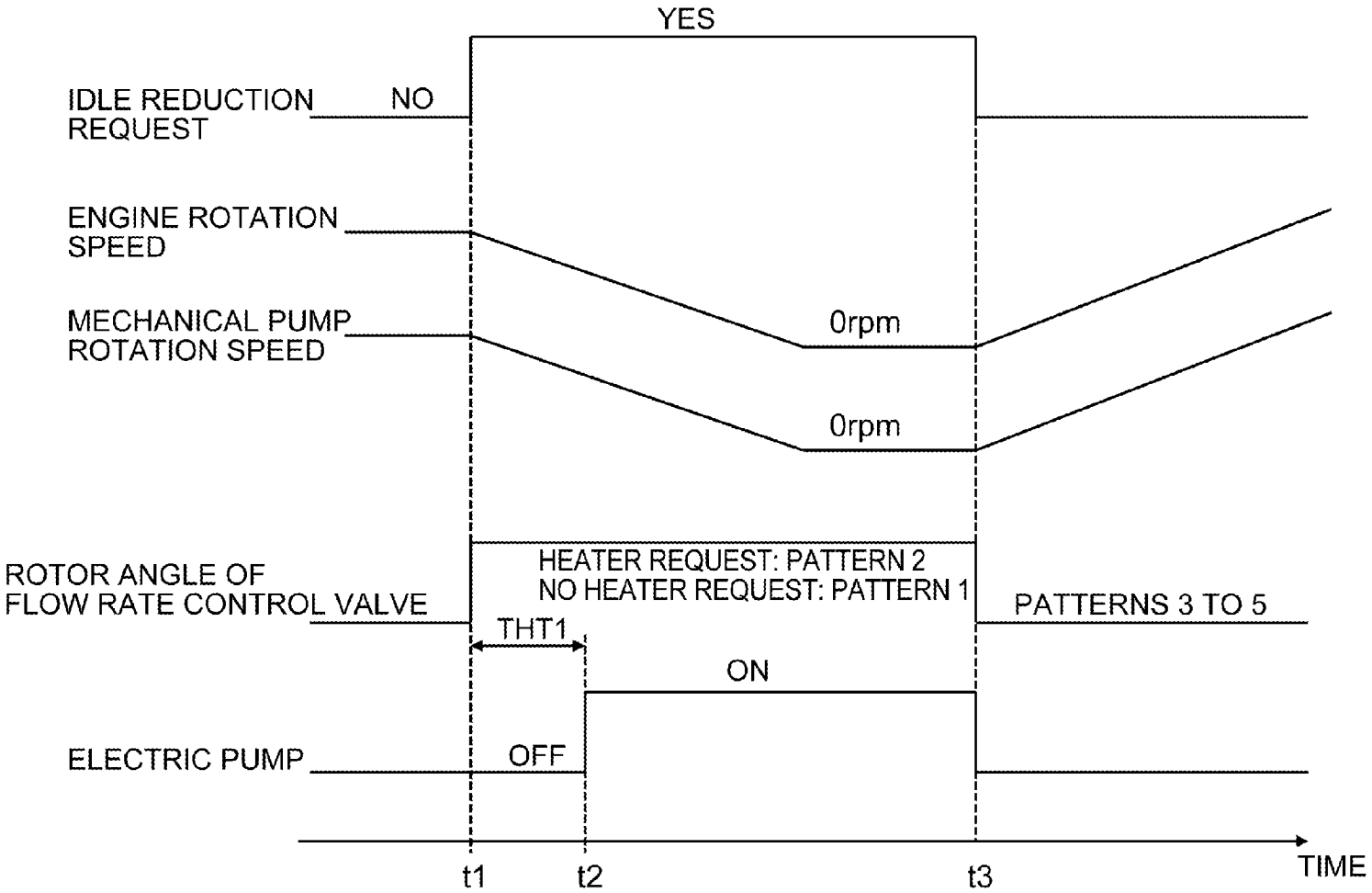
FIG. 7 is a flowchart exemplifying the activation control of the electric water pump during idle reduction, according to the embodiment of the present invention.

The time chart of FIG. 7 illustrates relations between variables, such as the rotation speed of internal combustion engine 10, the drive or stop of electric water pump 40, and the rotor angle of flow rate control valve 30, when electronic control device 100 controls the activation of electric water pump 40 according to the flowchart of FIG. 6.

In the time chart of FIG. 7, when an idle reduction request arises at time point t1, electronic control device 100 switches the rotor angle of flow rate control valve 30 to the predetermined angle determined based on whether or not it is requested to heat air for air-conditioning in heater core 91 while idle reduction is requested.

Thereafter, the rotation speeds of internal combustion engine 10 and mechanical water pump 45 decrease, and electronic control device 100 activates electric water pump 40 at time point t2 before internal combustion engine 10 and mechanical water pump 45 stop rotating.

Time point t2 is timing when the predetermined time THT1 elapses from time point t1, and set based on estimated timing at which the rotation speed of mechanical water pump 45 is be expected to be reduced enough to reduce the discharge rate thereof to below the set discharge rate of electric water pump 40, and/or timing at which the rotor angle of flow rate control valve 30 reaches the target angle for during the temporary engine stop.

Then, when, at time point t3, the idle reduction request is cancelled and internal combustion engine 10 is restarted, electronic control device 100 changes the target rotor angle of flow rate control valve 30 from the target angle for during temporary stop of internal combustion engine 10 to the target angle for during the operation of internal combustion engine 10, and stops the drive of electric water pump 40.

Note that, when the predetermined time THT1 is set so as to correspond to the estimated timing at which the discharge rate of mechanical water pump 45 is expected to be reduced to blow the set discharge rate of electric water pump 40, electronic control device 100 may change the predetermined time THT1 in accordance with the drive voltage for electric water pump 40, the rotation speed of internal combustion engine 10 at rising timing of the idle reduction request, or the like.

Here, the higher the drive voltage for electric water pump 40, the earlier the discharge rate of mechanical water pump 45 is reduced to below the set discharge rate of electric water pump 40. Accordingly, electronic control device 100 may set the predetermined time THT1 to a shorter time as the drive voltage for electric water pump 40 is set higher.

Also, the higher the rotation speed of internal combustion engine 10 at rising timing the idle reduction request, the later the discharge rate of mechanical water pump 45 is reduced to below the set discharge rate of electric water pump 40. Accordingly, electronic control device 100 may set the predetermined time THT1 to a longer time as the rotation speed of internal combustion engine 10 is higher at the rising timing of the idle reduction request.

When electronic control device 100 activates electric water pump 40 at the estimated timing when the discharge rate of mechanical water pump 45 is expected to be reduced to below the set discharge rate of electric water pump 40, electronic control device 100 may detect this timing for activating electric water pump 40 on the basis of the rotation speed of internal combustion engine 10.

Specifically, in this case, the processing of step S604 is replaced with processing of determining whether or not the rotation speed of internal combustion engine 10 is reduced to a predetermined rotation speed THN1 (0 rpm<THN1<idling rotation speed). When determining that the rotation speed of internal combustion engine 10 is reduced to the predetermined rotation speed THN1, the operation may proceed to step S605, in which electronic control device 100 activates electric water pump 40.

Here, the predetermined rotation speed THN1 is a value based on the rotation speed that reduces the discharge rate of mechanical water pump 45 to below the set discharge rate of electric water pump 40. Electronic control device 100 may store the predetermined rotation speed THN1 as a fixed value, or may change the predetermined rotation speed THN1 to a higher value as the drive voltage for electric water pump 40 is set higher.

Incidentally, if the rotor angle of flow rate control valve 30 is switched to the target angle for during the temporary stop of internal combustion engine 10 in synchronization with the rising of an idle reduction request, the following case can occur. Specifically, when a vehicle start-up request arises before the rotation speed of internal combustion engine 10 is reduced to approximately the rotation speed of a starter, internal combustion engine 10 is restarted immediately after the rising of the vehicle start-up request but the rotor angle of flow rate control valve 30 might return to the target angle for during the operation of internal combustion engine 10 with a delay from the vehicle start-up request.

To prevent or reduce such a delay of flow rate control valve 30 in responding the vehicle start-up request, electronic control device 100 may delay the start of the rotor angle switching of flow rate control valve 30 from the rising of the idle reduction request.

Figure 8:
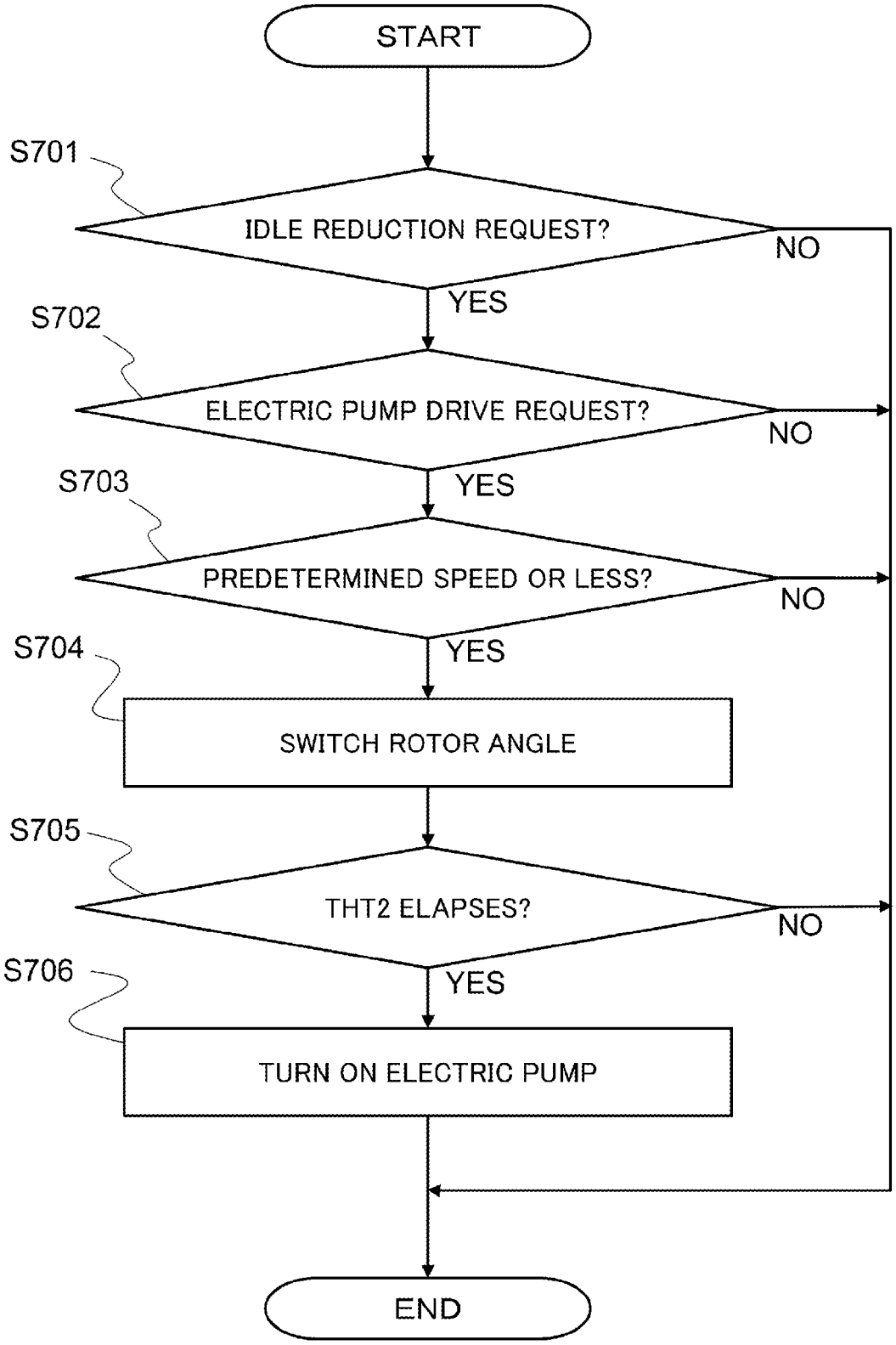
FIG. 8 is a flowchart exemplifying the activation control of the electric water pump during idle reduction, according to the embodiment of the present invention.

The flowchart of FIG. 8 represents an example of processing for delaying the start of the rotor angle switching of flow rate control valve 30 with respect to the rising of the idle reduction request.

In step S701, electronic control device 100 detects whether or not there is an idle reduction request. When detecting that there is no idle reduction request, in other words, detecting that internal combustion engine 10 is operating, this routine ends before the processing for driving electric water pump 40 is performed. Thereby, electronic control device 100 keeps electric water pump 40 stopped.

On the other hand, when determining that there is an idle reduction request, the operation proceeds to step S702, in which electronic control device 100 detects whether or not there is a drive request for electric water pump 40, similarly to aforementioned step S602.

When electronic control device 100 determines that there is a drive request for electric water pump 40, the operation proceeds to step S703, in which electronic control device 100 detects whether or not the rotation speed of internal combustion engine 10 is reduced to a predetermined speed THN.

When electronic control device 100 detects that the rotation speed of internal combustion engine 10 is higher than the predetermined speed THN, steps S704 and S705 are skipped and this routine ends, so that electronic control device 100 keeps electric water pump 40 stopped.

On the other hand, when electronic control device 100 detects that the rotation speed of internal combustion engine 10 is reduced to the predetermined speed THN, the operation proceeds to step S704. In step S704, electronic control device 100 detects whether or not a time elapses from when the rotation speed of internal combustion engine 10 becomes the predetermined speed THN reaches a predetermined time THT2.

When electronic control device 100 detects that the time elapses from when the rotation speed of internal combustion engine 10 becomes the predetermined speed THN is less than the predetermined time THT2, step S705 is skipped and this routine ends. Thereby, electronic control device 100 keeps electric water pump 40 stopped.

When electronic control device 100 detects that the time elapses from when the rotation speed of internal combustion engine 10 becomes the predetermined speed THN reaches the predetermined time THT2, the operation proceeds to step S705, in which electronic control device 100 starts power supply to electric water pump 40.

The predetermined speed THN in the above drive control of electric water pump 40 is based, for example, on the rotation speed of the starter. Specifically, internal combustion engine 10 rotating at the predetermined speed THN is expected to stop even though the vehicle start-up request arises.

In other words, the rotor angle of flow rate control valve 30 is controlled toward the target angle for during engine stop only after the rotation speed of internal combustion engine 10 is reduced to the predetermined speed THN. This prevents internal combustion engine 10 from operating under the condition where the rotor angle is set to an angle for during engine stop. This is because even if the vehicle start-up request arises immediately after the idle reduction request, there is enough time till internal combustion engine 10 is actually restarted.

In addition, electric water pump 40 is activated only after the delay period of the predetermined time THT2 elapses from the start of the control for setting the rotor angle of flow rate control valve 30 to the target angle for during engine stop. This prevents electric water pump 40 from being activated before the rotor angle of flow rate control valve 30 is actually switched to the target angle for during engine stop. Here, the predetermined time THT2 is set to a time required for flow rate control valve 30 to rotate till the rotor angle actually becomes the target angle for during engine stop after the control for such rotor angle switching is started.

Figure 9:
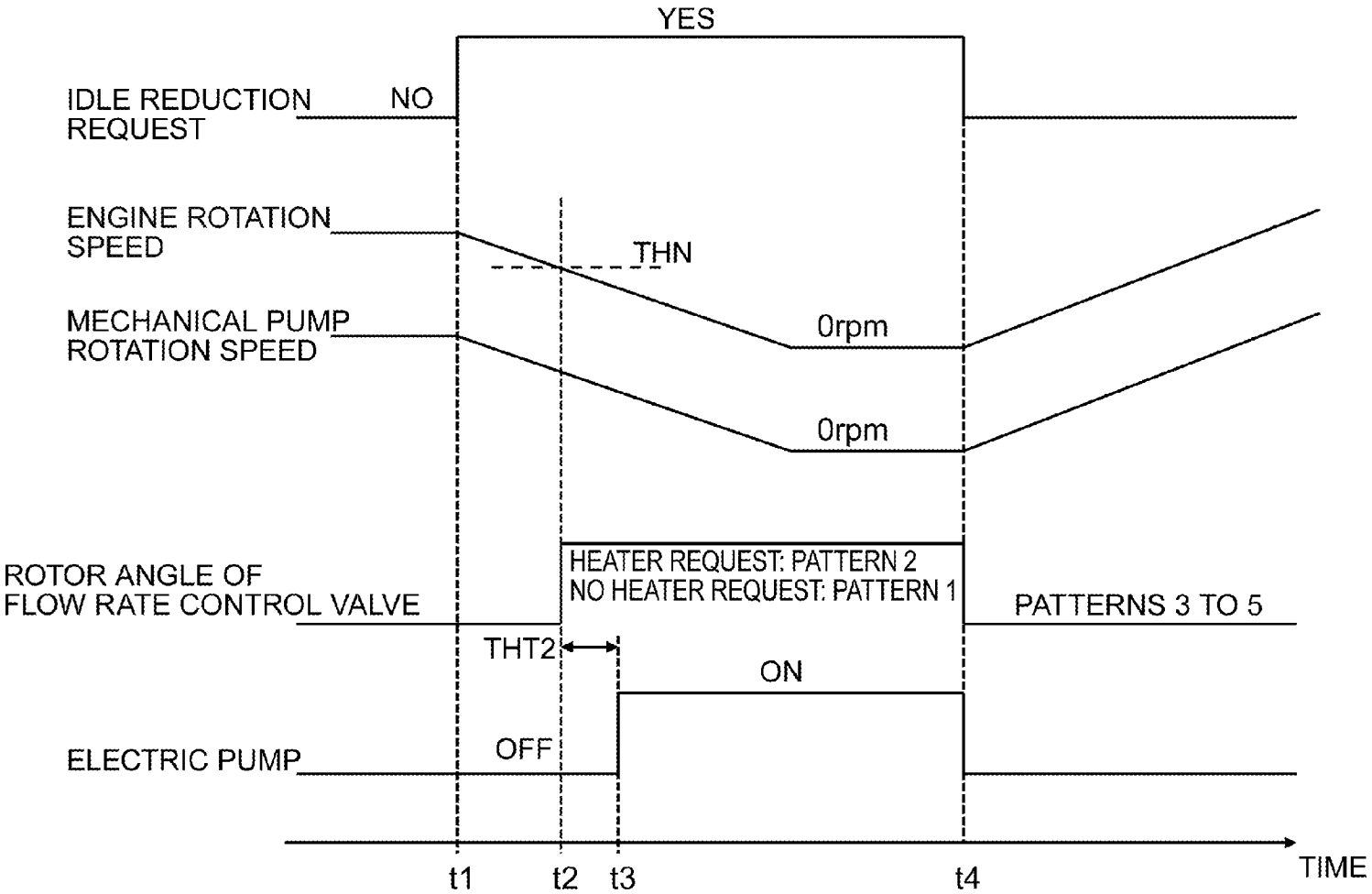
FIG. 9 is a time chart illustrating the activation control of the electric water pump during idle reduction, according to the embodiment of the present invention.

The time chart of FIG. 9 illustrates relations between variables, such as the rotation speed of internal combustion engine 10, the drive or stop of electric water pump 40, and the rotor angle of flow rate control valve 30, when electronic control device 100 controls the rotor angle switching of flow rate control valve 30 and the activation of electric water pump 40 according to the flowchart of FIG. 8.

In FIG. 9, an idle reduction request arises at time point t1, electronic control device 100 does not perform the rotor angle switching of flow rate control valve 30 nor the activation of electric water pump 40 at this timing.

Thereafter, when the rotation speed of internal combustion engine 10 is reduced to the predetermined speed THN at time point t2, electronic control device 100 switches the rotor angle of flow rate control valve 30 to the predetermined angle determined based on whether or not it is requested to heat air for air-conditioning in heater core 91 while idle reduction is requested.

Then, at time point t3 when the predetermined time THT2 elapses from time point t2 at which the switching control of flow rate control valve 30 is performed, in other words, at estimated timing when the rotor angle of flow rate control valve 30 is expected to be actually switched, electronic control device 100 activates electric water pump 40.

Alternatively, the rotor angle of flow rate control valve 30 may be switched when the rotation speed of internal combustion engine 10 is reduced to a predetermined speed, and electric water pump 40 may be activated at timing when the rotation speed of internal combustion engine 10 is reduced to another predetermined speed, which is still lower than the above predetermined speed.

Still alternatively, the drive voltage for electric water pump 40 may be incrementally increased to a target value.

Although the invention has been described in detail with reference to the preferred embodiment, it is apparent that the invention may be modified into various forms by one skilled in the art based on the fundamental technical concept and teachings of the invention. For example, flow rate control valve 30 is not limited to a rotor type. Alternatively, there may alternatively be used a flow rate control valve having a structure for allowing an electric actuator to linearly move its valve element.

Moreover, only heater core 91 may be disposed on fourth cooling water pipe 74. Alternatively, heater core 91 and any one or two of EGR cooler 92, exhaust gas recirculation control valve 93 and throttle valve 94 may be disposed on fourth cooling water pipe 74.

The passages connecting cooling water passage 62 to cooling water passage 61 do not have to be provided in the interior of internal combustion engine 10. Another piping configuration may be employed, instead. In an alternative piping configuration, an inlet of cooling water passage 62 is formed in cylinder block 12 and seventh cooling water pipe 77 branches into two pipes in the middle thereof. One of these branch pipes is connected to cooling water passage 61 while the other branch pipe is connected to cooling water passage 62.

In the cooling device, among the first to fourth cooling liquid lines, the fourth cooling liquid line may be omitted.

Moreover, the cooling device may have a structure in which oil cooler 16 is not disposed on the second cooling liquid line.

The switching characteristics of flow rate control valve 30 may be set so as to allow the following cooling water circulation during idle reduction. Specifically, all or some of the cooling water having passed through cylinder head 11 flows by way of radiator 50 and returns to electric water pump 40 so as to cool cylinder head 11 while the cooling water supply to cylinder block 12 is stopped.

Electric water pump 40 may be disposed on seventh cooling water pipe 77 at a point downstream to mechanical water pump 45 and upstream to internal combustion engine 10. Still alternatively, electric water pump 40 may be disposed on sixth cooling water pipe 76 at a point downstream to a connection to eighth cooling water pipe 78 and upstream to mechanical water pump 45.

Still alternatively, electric water pump 40 may be disposed on the bypass line through which the cooling water flows at a relatively low rate. This prevents electric water pump 40 from increasing waterflow resistance during the operation of mechanical water pump 45.

When the rotation speed of internal combustion engine 10 is not more than a predetermined speed during the operation of internal combustion engine 10, electronic control device 100 may drive electric water pump 40 to compensate for an insufficiency of the discharge rate of mechanical water pump 45.

Moreover, electronic control device 100 may drive electric water pump 40 and control the rotor angle of flow rate control valve 30 during a predetermined period from a driver's stop operation for internal combustion engine 10.

Furthermore, internal combustion engine 10 is not limited to an engine used as a vehicle drive source.

The cooling water includes an antifreeze liquid.

Flow rate control valve 30 may be configured to be biased by an elastic member in the rotation direction so that the rotor is at the maximum angle indicated in FIG. 2 by default, and to cause an electric actuator to rotate the rotor from this default angle against the biasing force of the elastic member.

REFERENCE SYMBOL LIST

10 Internal combustion engine
11 Cylinder head
12 Cylinder block
16 Oil cooler
20 Transmission (Power transmission device)
21 Oil warmer
30 Flow rate control valve
31 to 34 Inlet port
35 Outlet port
40 Electric water pump
45 Mechanical water pump
50 Radiator
61 Cooling water passage
62 Cooling water passage
71 First cooling water pipe
72 Second cooling water pipe
73 Third cooling water pipe
74 Fourth cooling water pipe
75 Fifth cooling water pipe
76 Sixth cooling water pipe
77 Seventh cooling water pipe
78 Eighth cooling water pipe
81 First temperature sensor
82 Second temperature sensor
91 Heater core
92 EGR cooler
93 Exhaust gas recirculation control valve
94 Throttle valve
100 Electronic control device

The invention claimed is:

1. A cooling device for an internal combustion engine, comprising:

a plurality of cooling liquid lines including a first cooling liquid line routed by way of a radiator and a cylinder head of the internal combustion engine while bypassing a cylinder block thereof, and a second cooling liquid line routed by way of the cylinder block while bypassing the radiator;

an electric flow rate control valve which has a plurality of inlet ports connected to outlets respectively of the plurality of cooling liquid lines, and which controls supply rates of cooling liquid respectively to the plurality of cooling liquid lines;

a bypass line that branches off from the first cooling liquid line at a point between the cylinder head and the radiator and that connects with an outlet port of the flow rate control valve while bypassing the radiator;

a mechanical water pump which is driven by the internal combustion engine to circulate the cooling liquid; and an electric water pump which is driven by a motor to circulate the cooling liquid.

2. The cooling device for the internal combustion engine according to claim 1, further comprising, as one of the plurality of cooling liquid lines, a third cooling liquid line routed by way of the cylinder head and a heater core while bypassing the radiator.

3. The cooling device for the internal combustion engine according to claim 2, further comprising, as one of the plurality of cooling liquid lines, a fourth cooling liquid line routed by way of the cylinder head and a power transmission device of the internal combustion engine while bypassing the radiator.

4. The cooling device for the internal combustion engine according to claim 1, wherein the outlet port of the flow rate control valve is connected to an intake port of the mechanical water pump, an outlet of the bypass line is connected to a point between the outlet port of the flow rate control valve and the intake port of the mechanical water pump, and the electric water pump is disposed on the bypass line.

5. The cooling device for the internal combustion engine according to claim 1, further comprising:

a first temperature sensor for measuring a temperature of the cooling liquid at an outlet of the cylinder head; and a second temperature sensor for measuring a temperature of the cooling liquid at an outlet of the cylinder block.

6. The cooling device for the internal combustion engine according to claim 2, wherein the flow rate control valve has a position at which all the plurality of inlet ports are closed, a position at which the inlet port connected to the third cooling liquid line is opened while the other inlet ports are closed, a position at which the inlet port connected to the second cooling liquid line and the inlet port connected to the third cooling liquid line are opened while the other inlet ports are closed, and a position at which all the plurality of inlet ports are opened.

7. The cooling device for the internal combustion engine according to claim 3, wherein the flow rate control valve has a position at which all the plurality of inlet ports are closed, a position at which the inlet port connected to the third cooling liquid line is opened while the other inlet ports are closed, a position at which the inlet port connected to the second cooling liquid line and the inlet port connected to the third cooling liquid line are opened while the other inlet ports are closed, a position at which all the plurality of inlet ports are opened, and a position at which the inlet port connected to the first cooling liquid line is closed while the other inlet ports are opened.

8. The cooling device for the internal combustion engine according to claim 6, further comprising a control unit for controlling the electric water pump and the flow rate control valve, wherein the control unit causes the electric water pump to operate during temporary stop of the internal combustion engine, and during the temporary stop of the internal combustion engine, the control unit controls the flow rate control valve at the position at which all the plurality of inlet ports are closed or at the position at which the inlet port connected to the third cooling liquid line is opened while the other inlet ports are closed.

9. The cooling device for the internal combustion engine according to claim 8, wherein when heat exchange in the heater core is requested, the control unit controls the flow rate control valve at the position at which the inlet port connected to the third cooling liquid line is opened while the other inlet ports are closed, and when the heat exchange in the heater core is not requested, the control unit controls the flow rate control valve at the position at which all the plurality of inlet ports are closed.

10. The cooling device for the internal combustion engine according to claim 1, further comprising a control unit for controlling the electric water pump and the flow rate control valve, wherein the control unit causes the electric water pump to operate during temporary stop of the internal combustion engine, and during the temporary stop of the internal combustion engine, the control unit controls the flow rate control valve so that the supply rates of the cooling liquid to the plurality of cooling liquid lines are reduced as compared to before the temporary stop of the internal combustion engine.

11. The cooling device for the internal combustion engine according to claim 2, further comprising a control unit for controlling the electric water pump and the flow rate control valve, wherein the control unit causes the electric water pump to operate during temporary stop of the internal combustion engine, and during the temporary stop of the internal combustion engine, the control unit controls the flow rate control valve so that the supply rates of the cooling liquid to, among the plurality of cooling liquid lines, the cooling liquid lines other than the third cooling liquid line are reduced as compared to before the temporary stop of the internal combustion engine.

12. The cooling device for the internal combustion engine according to claim 2, further comprising a control unit for controlling the electric water pump and the flow rate control valve, wherein the control unit causes the electric water pump to operate during temporary stop of the internal combustion engine, and when the heat exchange in the heater core is not requested during the temporary stop of the internal combustion engine, the control unit controls the flow rate control valve so that the supply rates of the cooling liquid to, among the plurality of cooling liquid lines, the cooling liquid lines other than the third cooling liquid line are reduced as compared to before the temporary stop of the internal combustion engine, and when heat exchange in the heater core is requested during the temporary stop of the internal combustion engine, the control unit controls the flow rate control valve so that the supply rates of the cooling water to the plurality of cooling liquid lines are reduced as compared to before the temporary stop of the internal combustion engine.

13. The cooling device for the internal combustion engine according to claim 8, wherein, during the temporary stop of the internal combustion engine, the control unit increases a discharge rate of the electric water pump along with an increase in a temperature of the cylinder head.

14. The cooling device for the internal combustion engine according to claim 8, wherein, when heat exchange in the heater core is requested during the temporary stop of the internal combustion engine, the control unit increases a discharge rate of the electric water pump as compared to when the heat exchange is not requested.

15. The cooling device for the internal combustion engine according to claim 8, wherein the control unit activates the electric water pump after a predetermined delay period elapses from issue of a command to temporarily stop the internal combustion engine.

16. A control method for a cooling device for an internal combustion engine, the cooling device including a plurality of cooling liquid lines including a first cooling liquid line routed by way of a radiator and a cylinder head of the internal combustion engine while bypassing a cylinder block thereof, and a second cooling liquid line routed by way of the cylinder block while bypassing the radiator, an electric flow rate control valve which has a plurality of inlet ports connected to outlets respectively of the plurality of cooling liquid lines, and which controls supply rates of cooling liquid respectively to the plurality of cooling liquid lines, a bypass line that branches off from the first cooling liquid line at a point between the cylinder head and the radiator and that connects with an outlet port of the flow rate control valve while bypassing the radiator, a mechanical water pump which is driven by the internal combustion engine to circulate the cooling liquid, and an electric water pump which is driven by a motor to circulate the cooling liquid, the control method comprising the steps of:

detecting temporary stop of the internal combustion engine;

causing the electric water pump to operate in response to the temporary stop of the internal combustion engine; and switching a position of the flow rate control valve in response to the temporary stop of the internal combustion engine.

* * * * *